US012116777B2

(12) United States Patent
Niiya

(10) Patent No.: US 12,116,777 B2
(45) Date of Patent: Oct. 15, 2024

(54) MATERIAL SET AND METHOD OF INSTALLING THE SAME

(71) Applicant: TAKESHIN PACKAGE CO., LTD., Okayama (JP)

(72) Inventor: Keiichiro Niiya, Okayama (JP)

(73) Assignee: TAKESHIN PACKAGE CO., LTD., Okayama (JP)

( * ) Notice: Subject to any disclaimer, the term of this patent is extended or adjusted under 35 U.S.C. 154(b) by 0 days.

(21) Appl. No.: 17/905,195

(22) PCT Filed: Nov. 22, 2021

(86) PCT No.: PCT/JP2021/042804
§ 371 (c)(1),
(2) Date: Aug. 29, 2022

(87) PCT Pub. No.: WO2022/172552
PCT Pub. Date: Aug. 18, 2022

(65) Prior Publication Data

US 2023/0383529 A1 Nov. 30, 2023

(30) Foreign Application Priority Data

Feb. 12, 2021 (JP) ..... 2021-020495

(51) Int. Cl.
*E04B 1/84* (2006.01)

(52) U.S. Cl.
CPC .... *E04B 1/8404* (2013.01); *E04B 2001/8476* (2013.01)

(58) Field of Classification Search
CPC ..... E04B 1/8404; E04B 2001/8476; E04B 2001/8423; E04B 2001/848; E04F 13/0871; E04F 13/0862
See application file for complete search history.

(56) References Cited

U.S. PATENT DOCUMENTS

2003/0208978 A1* 11/2003 Chen ..... E04F 13/0862 52/489.1
2009/0297754 A1* 12/2009 Kim ..... E04F 13/12 428/44

(Continued)

FOREIGN PATENT DOCUMENTS

DE 1920903 A1 * 12/1970
EP 1 457 613 A1 9/2004

(Continued)

OTHER PUBLICATIONS

International Search Report dated Dec. 21, 2021 issued in PCT/JP2021/042804.

*Primary Examiner* — Christine T Cajilig
(74) *Attorney, Agent, or Firm* — Pearne & Gordon LLP

(57) ABSTRACT

The shape of an attachment (3*a* to 3*d*) is a one-fold shape, which is inscribed in a rectangle, or an integer-fold shape, which is inscribed in sides of a shape formed by an integer number of rectangles arranged side by side. Covers include a one-fold cover (2*a*), which has a size that allows the cover to be attached to a one-fold attachment (3*a*) or an integer-fold cover (2*b* to 2*d*), which has a size that allows the cover to be attached to an integer-fold attachment (3*b* to 3*d*). Variations of a design pattern formed by a plurality of covers can be provided by attaching the one-fold cover (2*a*) to the one-fold attachment (3*a*), attaching the integer-fold cover (2*b* to 2*d*) to an integer number of one-fold attachments (3*a*), or attaching the integer-fold cover (2*b* to 2*d*) to the integer-fold attachment (3*b* to 3*d*).

5 Claims, 26 Drawing Sheets

(56) References Cited

U.S. PATENT DOCUMENTS

| | | | | |
|---|---|---|---|---|
| 2015/0191914 | A1 | 7/2015 | Biterman | |
| 2015/0322679 | A1* | 11/2015 | Vigouroux | E04F 13/12 52/506.05 |
| 2017/0234018 | A1* | 8/2017 | Bovijn | E04F 15/022 52/506.05 |

FOREIGN PATENT DOCUMENTS

| | | | |
|---|---|---|---|
| EP | 3216940 | A1 * | 9/2017 |
| EP | 3757312 | A1 | 12/2020 |
| JP | H04-47035 | U | 4/1992 |
| JP | H07-102657 | A | 4/1995 |
| JP | H07-113276 | A | 5/1995 |
| JP | 2009-275474 | A | 11/2009 |
| JP | 5848838 | B1 | 1/2016 |

* cited by examiner (a)

(b)

(c)

(a)

(b)

MATERIAL SET AND METHOD OF INSTALLING THE SAME

TECHNICAL FIELD

The present disclosure relates to a design material set that covers a target surface, such as a wall or a ceiling, and a method of installing the same.

BACKGROUND

It has been a common practice to lay sound absorbing materials on a ceiling or wall to produce an uneven ceiling and wall, thereby achieving an aesthetic effect as well as a sound absorbing effect. For example, with the sound absorbing material set described in Patent Literature 1, the sound absorbing body includes an attachment to be attached to a panel and a case body to be assembled to the attachment. With this arrangement, the case body can be designed to have an outward appearance that produces a decorative effect so that the sound absorbing body installed has a good and desired appearance.

It has also been proposed that a functional material, such as a heat insulator, once installed on a ceiling or a wall can be removed or replaced. For example, the functional building panel described in Patent Literature 2 enables a functional material to be attached to and removed from a structural material fixed to a building, thereby enabling the functional material to be easily removed or replaced with another functional material after construction.

CITATION LIST

Patent Literature

Patent Literature 1: Japanese Patent No. 5848838

Patent Literature 2: Japanese Patent Application Laid-open No. 7-113276

SUMMARY

However, with the sound absorbing material set described in Patent Literature 1, although the outward appearance of the case body can be designed to have a decorative effect, the outside dimensions of the case body are uniform, and the outward appearance can be modified only within the range of the uniform outside dimensions of the case body. The same holds true for the functional building panel described in Patent Literature 2. Although functional materials can be replaced with other functional materials, the functional materials must have dimensions within the range of the uniform outside dimensions.

The present disclosure has been devised to solve the conventional problems described above, and an object of the present disclosure is to provide a design material set having many variations of the design pattern, and a method of installing the same.

In order to attain the object described above, a design material set according to the present disclosure is a design material set that covers a target surface, the design material set comprising: an attachment; and a cover to be attached to the attachment, wherein the attachment and the cover have a base and a side wall surrounding the base, the cover is capable of being attached to the attachment by fitting between the side wall of the cover and the side wall of the attachment, a shape of a part of the attachment facing the cover in plan view is a one-fold shape, which is inscribed in a rectangle, or an integer-fold shape, which is inscribed in sides of a shape formed by an integer number of rectangles arranged side by side, provided that an attachment of the one-fold shape is referred to as a one-fold attachment, and an attachment of the integer-fold shape is referred to as an integer-fold attachment, the design material set includes a plurality of covers, the covers including a one-fold cover, which has a size that allows the cover to be attached to the one-fold attachment, or an integer-fold cover, which has a size that allows the cover to be attached to the integer-fold attachment, and including at least integer-fold covers of different integer-fold numbers, when a plurality of attachments is arranged lengthwise and widthwise side by side on the target surface, a design pattern formed by a plurality of covers can be configured by attaching the one-fold cover to the one-fold attachment, attaching the integer-fold cover to an integer number of one-fold attachments, the integer number being equal to or greater than 2, or attaching the integer-fold cover to the integer-fold attachment, the design pattern can be changed by removing a cover from the attachment and attaching a new cover, or rearranging the covers, the design pattern can be changed by replacing the integer-fold cover attached to the attachment with an integer-fold cover of a different integer-fold number, and the design pattern can be changed by changing the orientation of the integer-fold cover attached to the attachment to a lengthwise orientation or a widthwise orientation.

A method of installing a design material set according to the present disclosure is a method of installing a design material set that covers a target surface, wherein the design material set comprises: an attachment; and a cover to be attached to the attachment, the attachment and the cover have a base and a side wall surrounding the base, the cover is capable of being attached to the attachment by fitting between the side wall of the cover and the side wall of the attachment, a shape of a part of the attachment facing the cover in plan view is a one-fold shape, which is inscribed in a rectangle, or an integer-fold shape, which is inscribed in sides of a shape formed by an integer number of rectangles arranged side by side, provided that an attachment of the one-fold shape is referred to as a one-fold attachment, and an attachment of the integer-fold shape is referred to as an integer-fold attachment, the design material set includes a plurality of covers, the covers including a one-fold cover, which has a size that allows the cover to be attached to the one-fold attachment, or an integer-fold cover, which has a size that allows the cover to be attached to the integer-fold attachment, and including at least integer-fold covers of different integer-fold numbers, a plurality of attachments is arranged lengthwise and widthwise side by side on the target surface, a design pattern formed by a plurality of covers is configured by attaching the one-fold cover to the one-fold attachment, attaching the integer-fold cover to an integer number of one-fold attachments, the integer number being equal to or greater than 2, or attaching the integer-fold cover to the integer-fold attachment, the design pattern can be changed by removing a cover from the attachment and attaching a new cover, or rearranging the covers, the design pattern can be changed by replacing the integer-fold cover attached to the attachment with an integer-fold cover of a different integer-fold number, and the design pattern can be changed by changing the orientation of the integer-fold cover attached to the attachment to a lengthwise orientation or a widthwise orientation.

With the design material set and the method of installing the design material set according to the present disclosure, once attachments are attached to the target surface, one-fold covers can be attached to the attachments, integer-fold covers of different integer-fold numbers can be attached to the attachments, integer-fold covers can be attached to the attachments in different orientations, both one-fold covers and integer-fold covers can be attached to the attachments, and covers having differently embossed surfaces or having different colors can be attached to the attachments. Thus, the flexibility of the correspondence between the attachments and the covers increases, the variations of the design pattern increase, and the design pattern can be changed in a wider variety of ways.

In addition, the attachment can have a wide variety of shapes that are inscribed in a rectangle, and the cover can also have a wide variety of shapes conforming to the shapes of the attachment. This also increases the variations of the design pattern formed by a plurality of covers. In addition, by installing not only one-fold attachments but also integer-fold attachments on the target surface depending on the planed design pattern, the number of attachments can be reduced, and the efficiency of operation is improved.

In the design material set and the method of installing the design material set according to the present disclosure, attachment of the cover to the attachment is preferably attained by friction between the cover and the attachment. With this configuration, fixing can be achieved without using a dedicated fixture, and the removal is easy.

Furthermore, a hollow space is preferably formed inside the cover when the cover is attached to the attachment. With this configuration, the assembly of the attachment and the cover can have a sound absorbing effect, and can be used as a sound absorbing body.

Effects of the present disclosure are as described above. According to the present disclosure, once attachments are attached to the target surface, one-fold covers can be attached to the attachments, integer-fold covers of different integer-fold numbers can be attached to the attachments, integer-fold covers can be attached to the attachments in different orientations, both one-fold covers and integer-fold covers can be attached to the attachments, and covers having differently embossed surfaces or having different colors can be attached to the attachments. Thus, the flexibility of the correspondence between the attachments and the covers increases, the variations of the design pattern increase, and the design pattern can be changed in a wider variety of ways. In addition, the attachment can have a wide variety of shapes that are inscribed in a rectangle, and the cover can also have a wide variety of shapes conforming to the shapes of the attachment. This also increases the variations of the design pattern formed by a plurality of covers. In addition, by installing not only one-fold attachments but also integer-fold attachments on the target surface depending on the planed design pattern, the number of attachments can be reduced, and the efficiency of operation is improved.

DETAILED DESCRIPTION OF THE EMBODIMENTS

Figure 1:
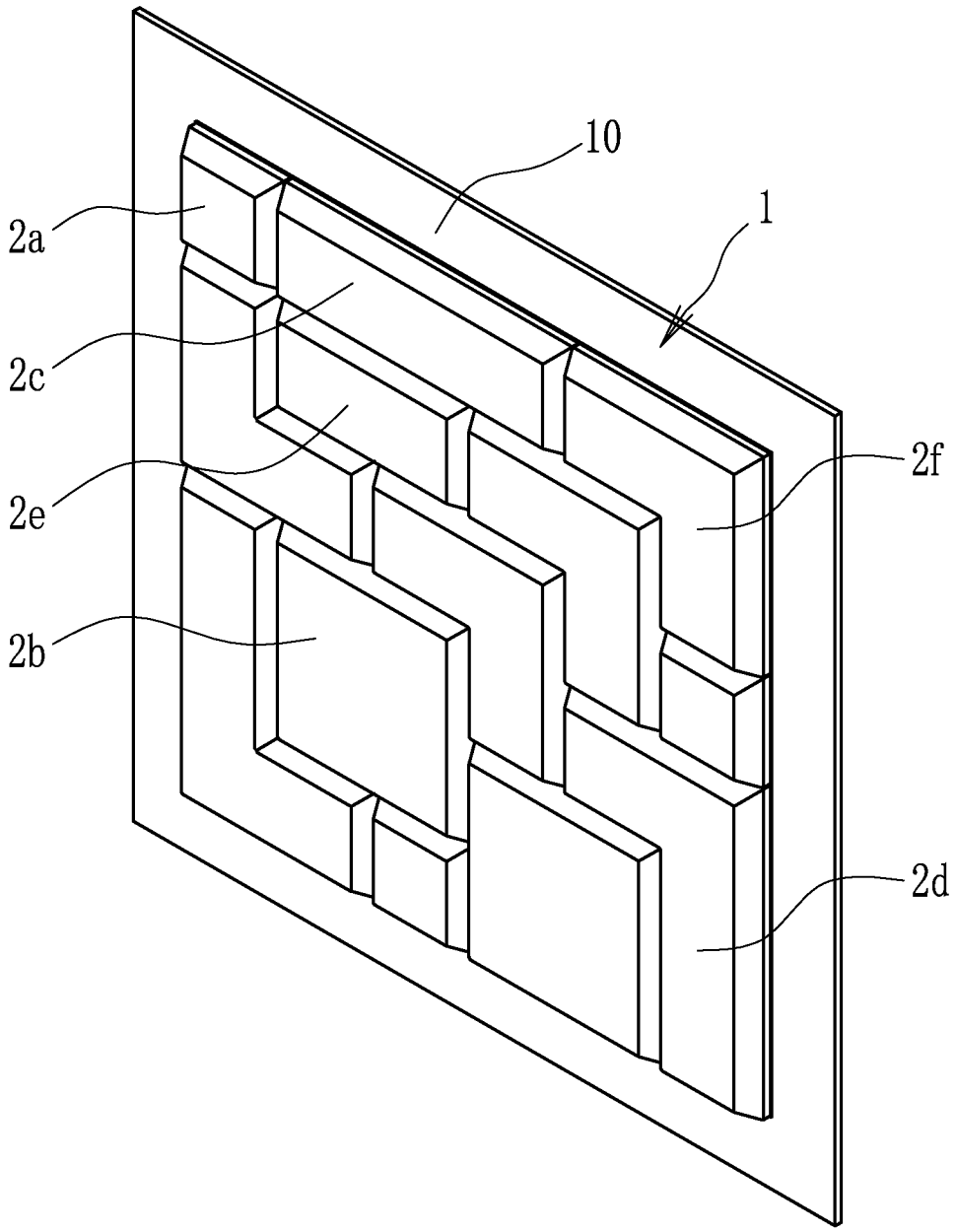
FIG. 1 is a perspective view of a design material set according to an embodiment of the present disclosure installed on a wall.
Figure 2:
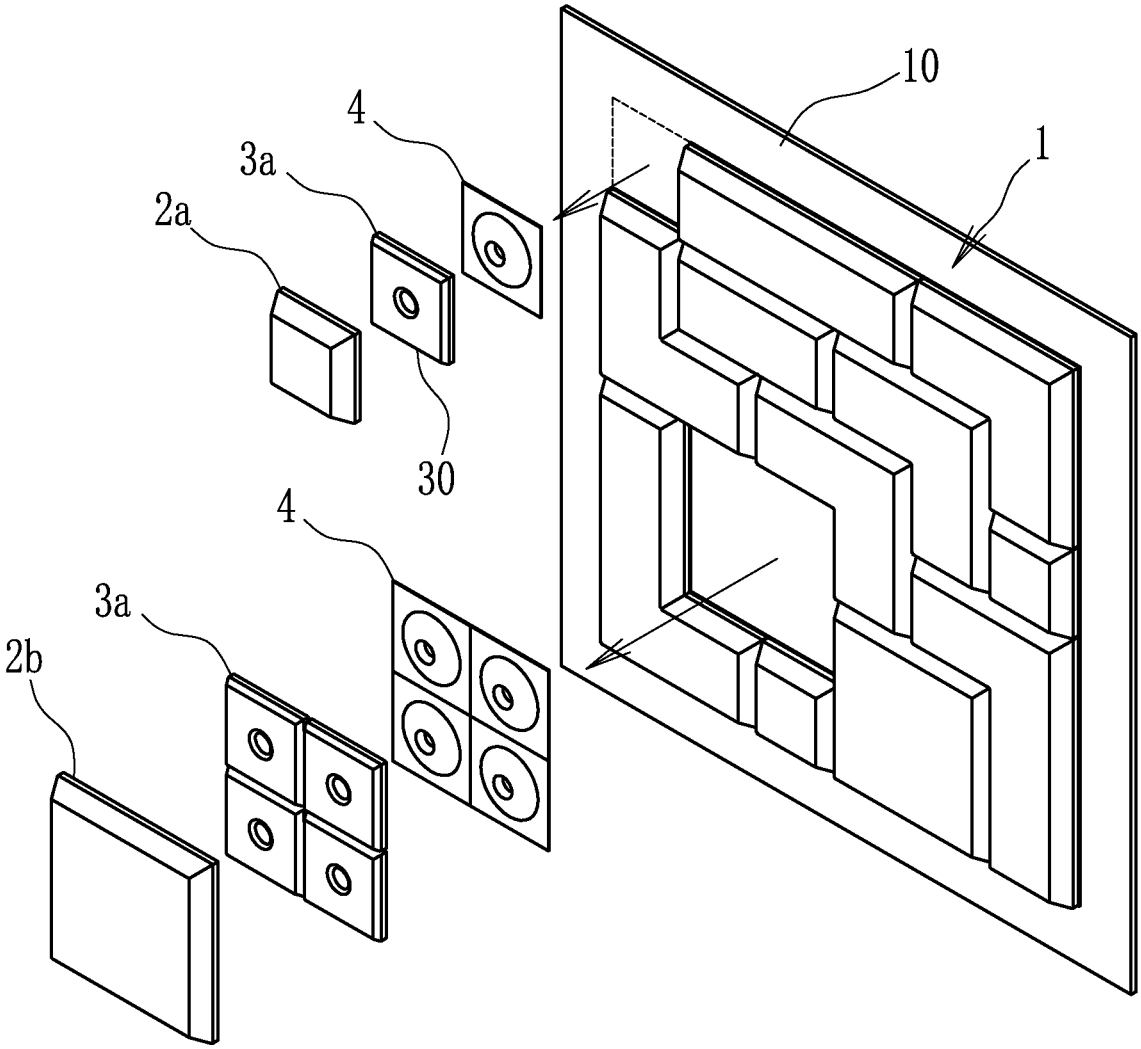
FIG. 2 is a partially exploded perspective view of the design material set in FIG. 1.

In the following, an embodiment of the present disclosure will be described with reference to the drawings. FIG. 1 is a perspective view of a design material set 1 according to an embodiment of the present disclosure installed on a wall 10, which is a target surface. FIG. 2 is a partially exploded perspective view of the design material set 1 in FIG. 1. As illustrated in FIG. 1, the wall 10 is covered by covers 2*a* to 2*f* of various shapes forming the design material set 1. Although the wall 10 is partially illustrated in FIG. 1 for convenience of explanation, the design material set 1 may cover a larger area of the wall, and can cover not only the wall but also a ceiling.

Installing the design material set 1 can enhance the appearance of the wall or ceiling that is a target surface or modify the appearance of the wall or ceiling as desired. In addition, the design material set 1 can have a sound absorbing effect. For example, the sound absorbing effect can be attained by forming a hollow space inside the design material set or putting a sound absorbing material, such as urethan foam, in the hollow space.

The design material set 1 has a plurality of types of covers. FIG. 1 illustrates an example in which covers 2*a* to 2*f* of six types of shapes are selected from among such a plurality of types of covers, and installed on the wall 10. In FIG. 2, the cover 2*a* and the like are each attached to an attachment 3*a*. As described in detail later, the design material set 1 may have a plurality of covers in addition to the covers installed on the wall 10 illustrated in FIG. 1, and those covers may have different shapes than the covers 2*a* to 2*f*. Similarly, the design material set 1 may have a plurality of attachments other than the attachments 3*a* illustrated in FIG. 2, and those attachments may have different shapes than the attachments 3*a*.

In this embodiment, a particular cover is referred to by using a reference numeral, such as cover 2*a* or cover 2*b*, while the covers are collectively referred to simply as covers. Similarly, a particular attachment is referred to by using a reference numeral, such as attachment 3*a* or attachment 3*b*, while the attachments are collectively referred to simply as attachments.

In FIG. 2, the cover 2*a* is installed on the wall 10 with the attachment 3*a* and a substrate 4. The same holds true for the cover 2*b*, but four attachments 3*a* and four substrates 4 are used for the cover 2*b*. However, this is just an example, four attachments 3*a* and four substrates 4 may be each integrated, or two attachments 3*a* and two substrates 4 may be each integrated and used.

While the substrate 4 is fixed to the wall 10 with an adhesive, a catch or the like, the attachment 3*a* and the cover, such as the cover 2*a*, are removably attached. This will be described with reference to FIGS. 3 and 4.

Figure 3:
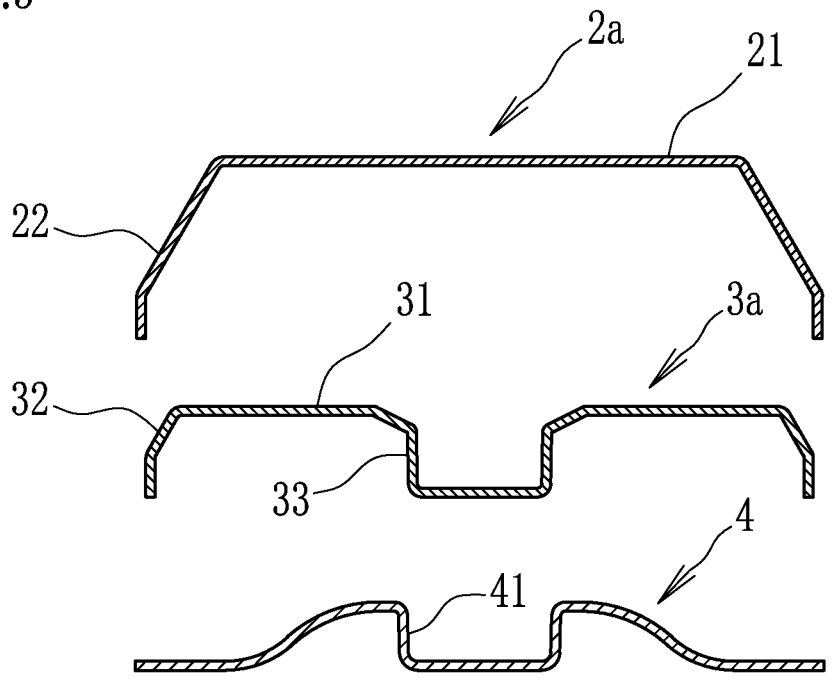
FIG. 3 is a cross-sectional view of a cover, an attachment, and a substrate according to the embodiment of the present disclosure.

FIG. 3 is a cross-sectional view of the cover 2*a*, the attachment 3*a*, and the substrate 4. The cover 2*a* has a base 21 and a side wall 22 that surrounds the base 21. The attachment 3*a* has a base 31 and a side wall 32 that surrounds the base 31. An inner surface of the side wall 22 of the cover 2*a* and an outer surface of the side wall 32 of the attachment 3*a* are fitted to each other. A projection 33 of the attachment 3 is fitted into a recess 41 of the substrate 4. That is, the cover 2*a* and the attachment 3*a* are fixed to each other by the frictional force between the members fitted to each other, and the attachment 3*a* and the substrate 4 are fixed to each other by the frictional force between the members fitted to each other. With this configuration, fixing can be achieved without using a dedicated fixture. Once the substrate 4 is installed, the cover 2*a* and the attachment 3*a* can be attached to and removed from the substrate 4 and thus attached to and removed from the wall 10, and the attachment and removal are easy. This holds true for the other covers, such as the cover 2*b*, and for the other attachments, such as the attachment 3*b* (see FIG. 5(*b*)).

Figure 4:
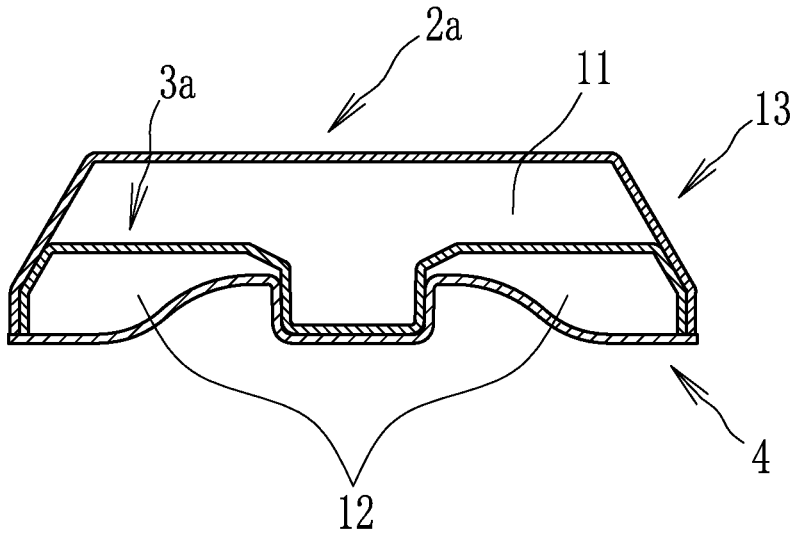
FIG. 4 is a cross-sectional view of the cover, the attachment, and the substrate assembled from the state in FIG. 3.

FIG. 4 is a cross-sectional view of an assembly 13, which is formed by the cover 2*a*, the attachment 3*a*, and the substrate 4 assembled from the state in FIG. 3. In the state in FIG. 4, a hollow part 11 and a hollow part 12 are formed in the assembly 13, and the assembly 13 has a sound absorbing effect and can be used as a sound absorbing material.

In FIG. 2, the attachment 3*a* is an attachment of the minimum size among the attachments of the design material set 1. In this embodiment, size refers to area in plan view. As described in detail later, the attachments may include an attachment of a size that is integer-times larger than the size of the attachment 3*a*. Similarly, in FIG. 2, the cover 2*a* is a cover of the minimum size among the covers of the design material set 1. The cover 2*b* has a size that is four times larger than the size of the cover 2*a*.

The shape of a part of the attachment 3*a* facing the cover 2*a* in plan view corresponds to a rectangle 30 and therefore is inscribed in the rectangle 30. The shape inscribed in the rectangle 30 means a shape all or some of the sides of which lie on sides of the rectangle 30. In this embodiment, concerning the shape of the attachment in plan view, a shape inscribed in the rectangle 30 is referred to as a one-fold shape, and a shape inscribed in the sides of a shape formed by an integer number of rectangles 30 arranged side by side is referred to as an integer-fold shape. Furthermore, an attachment of the one-fold shape is referred to as a one-fold attachment, and an attachment of the integer-fold shape is referred to as an integer-fold attachment.

Figure 5:
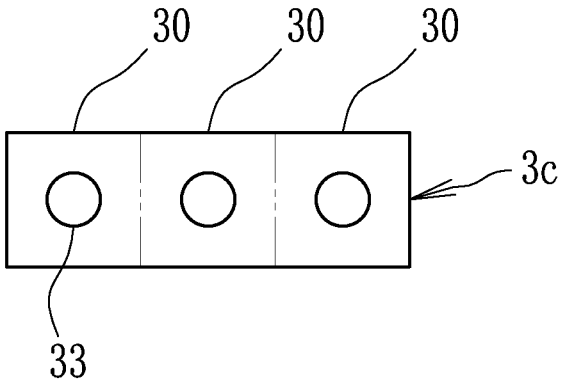
FIG. 5 are plan views illustrating examples of an integer-fold attachment according to the embodiment of the present disclosure.
Figure 5:
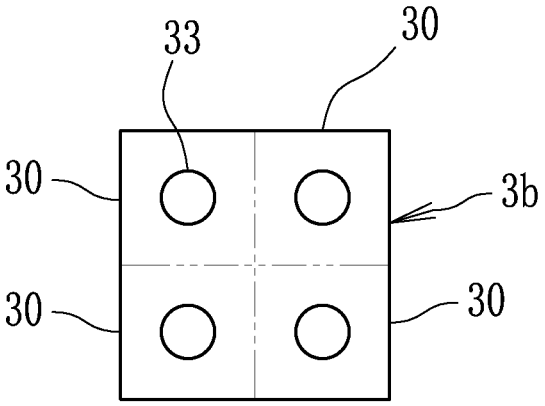
Figure 5:
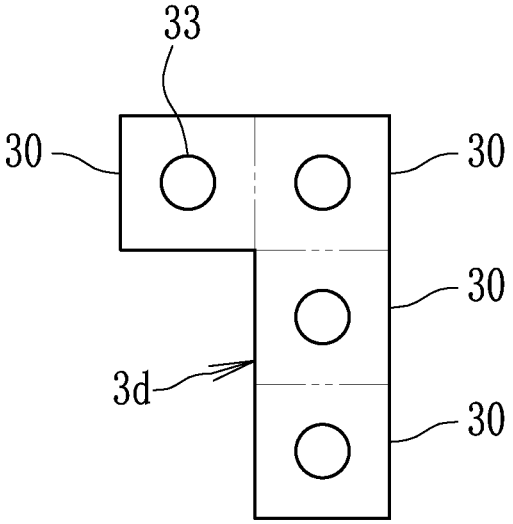

FIG. 5 are plan views illustrating examples of the integer-fold attachment. FIG. 5(*a*) illustrates an example of an integer-fold attachment of a three-fold number. An attachment 3*c* illustrated in FIG. 5(*a*) is inscribed in the sides of an oblong rectangle formed by three rectangles 30 arranged widthwise side by side. The attachment 3*c* corresponds to three attachments 3*a* illustrated in FIG. 2 integrated. FIG. 5(*b*) illustrates an example of an integer-fold attachment of a four-fold number. The attachment 3*b* illustrated in FIG. 5(*b*) is inscribed in the sides of a rectangle formed by four rectangles 30 arranged lengthwise and widthwise side by side. FIG. 5(*c*) illustrates another example of the integer-fold attachment of the four-fold number. An attachment 3*d* illustrated in FIG. 5(*c*) is inscribed in the sides of an L-shaped figure formed by four rectangles 30 arranged lengthwise and widthwise side by side. The attachment 3*b* and the attachment 3*d* correspond to four attachments 3*a* illustrated in FIG. 2 integrated.

The attachment 3*b* to 3*d* illustrated in FIG. 5 are examples, and an integer-fold attachment of a two-fold number or an integer-fold attachment of a five or more-fold number is also possible. The shapes of the attachments 3*b* to 3*d* are also examples. Although these shapes correspond to shapes formed by an integer number of rectangles 30 arranged side by side, any shape inscribed in such a shape is possible.

Figure 6:
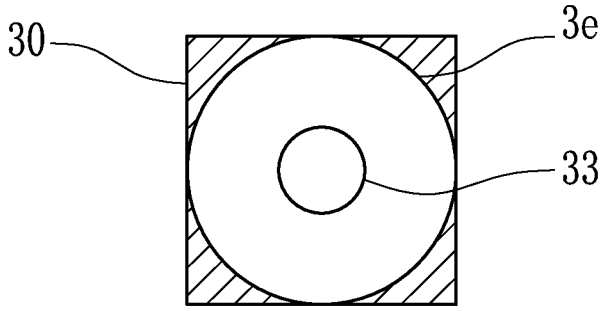
FIG. 6 are plan views illustrating other examples of the shape of the attachment according to the embodiment of the present disclosure.
Figure 6:
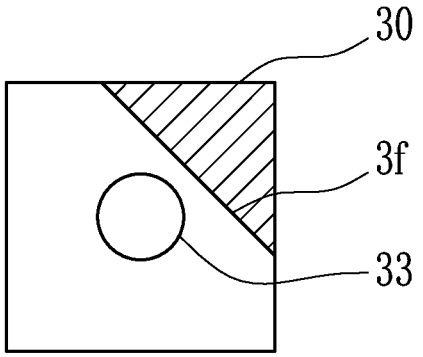

FIG. 6 are plan views illustrating other examples of the shape of the attachment. While the shape of the attachment 3*a* in plan view illustrated in FIG. 2 corresponds to the rectangle 30, the shape of the attachment in plan view is not limited to the rectangle and can be any shape inscribed in the rectangle 30. The hatched parts in FIG. 6 are parts cut away from the rectangle 30, and the remainder after cutting these parts away from the rectangle 30 is the shape of each attachment in plan view.

The shape of an attachment 3*e* in plan view illustrated in FIG. 6(*a*) is a circle inscribed in the rectangle 30, and the shape of an attachment 3*f* in plan view illustrated in FIG. 6(*b*) is a trapezoid inscribed in the rectangle 30. The shapes of the attachments illustrated in FIG. 6 are examples, and any shape inscribed in the rectangle 30 is possible, and other shapes are possible. Since the attachments have a wide variety of shapes, covers of a wide variety of shapes can be used (see FIGS. 28 and 30), so that variations of the design pattern formed by a plurality of covers can be increased.

In FIG. 1, the design material set 1 includes six types of covers 2*a* to 2*f* having different sizes or shapes. As illustrated in FIG. 2, the cover 2*a* can be attached to the attachment 3*a*, which is a one-fold attachment. The cover 2*b* can be attached to four attachments 3*a*, each of which is a one-fold attachment, and therefore can be attached to an integer-fold attachment of a four-fold number. In this embodiment, a cover that has a size that allows the cover to be attached to the one-fold attachment is referred to as a one-fold cover, and a cover that has a size that allows the cover to be attached to an integer-fold attachment is referred to as an integer-fold cover.

Figure 7:
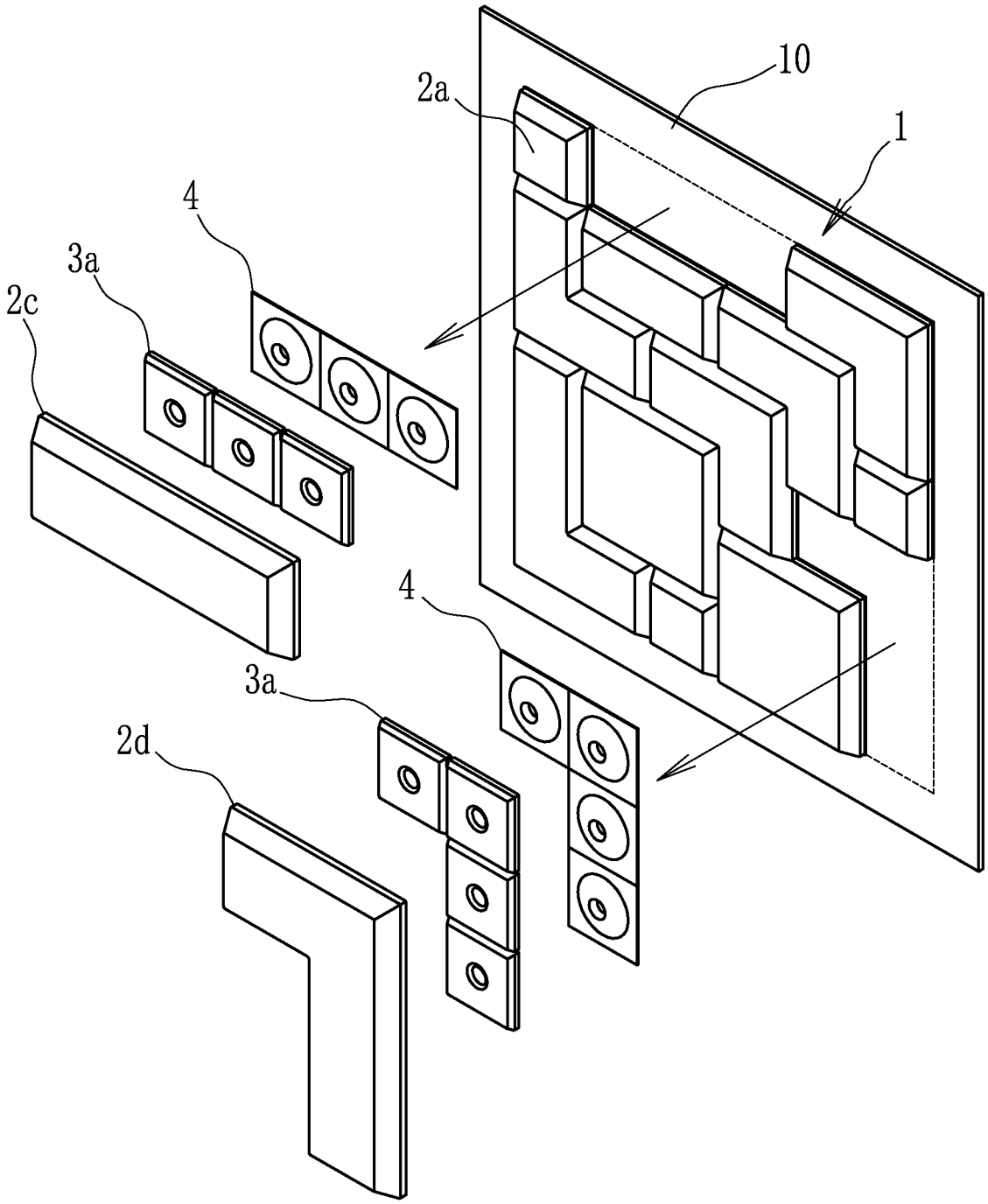
FIG. 7 is a partially exploded perspective view of the design material set in FIG. 1.

In FIG. 2, the cover 2*a* is a one-fold cover, and the cover 2*b* is an integer-fold cover of the four-fold number. FIG. 7 is a partially exploded perspective view of the design material set 1 in FIG. 1. In FIG. 7, different parts of the design material set 1 than those in FIG. 2 are disassembled. In FIG. 7, a cover 2*c* is an integer-fold cover of the three-fold number, and a cover 2*d* is an integer-fold cover of the four-fold number. Similarly, in FIG. 1, a cover 2*e* is an integer-fold cover of the two-fold number, and a cover 2*f* is an integer-fold cover of the three-fold number.

In short, in FIG. 1, the design material set 1 includes the cover 2*a* (a one-fold cover), the cover 2*b* (an integer-fold cover of the four-fold number), the cover 2*c* (an integer-fold cover of the three-fold number), the cover 2*d* (an integer-fold cover of the four-fold number), the cover 2*e* (an integer-fold cover of the two-fold number), and the cover 2*f* (an integer-fold cover of the three-fold number).

The covers illustrated in FIG. 1 may be all the covers of the design material set 1. However, the design material set 1 may further includes a cover that is the same as any of the covers 2*a* to 2*e* or an integer-fold cover of a five or more-fold number.

As described above with reference to FIGS. 3 and 4, the cover 2*a* can be attached to and removed from the attachment 3*a*. Because of this and the fact that the covers include a one-fold cover and integer-fold covers of different integer-fold numbers, the variations of the design pattern formed by a plurality of covers increase, and the design pattern can be changed in a wider variety of ways.

Figure 8:
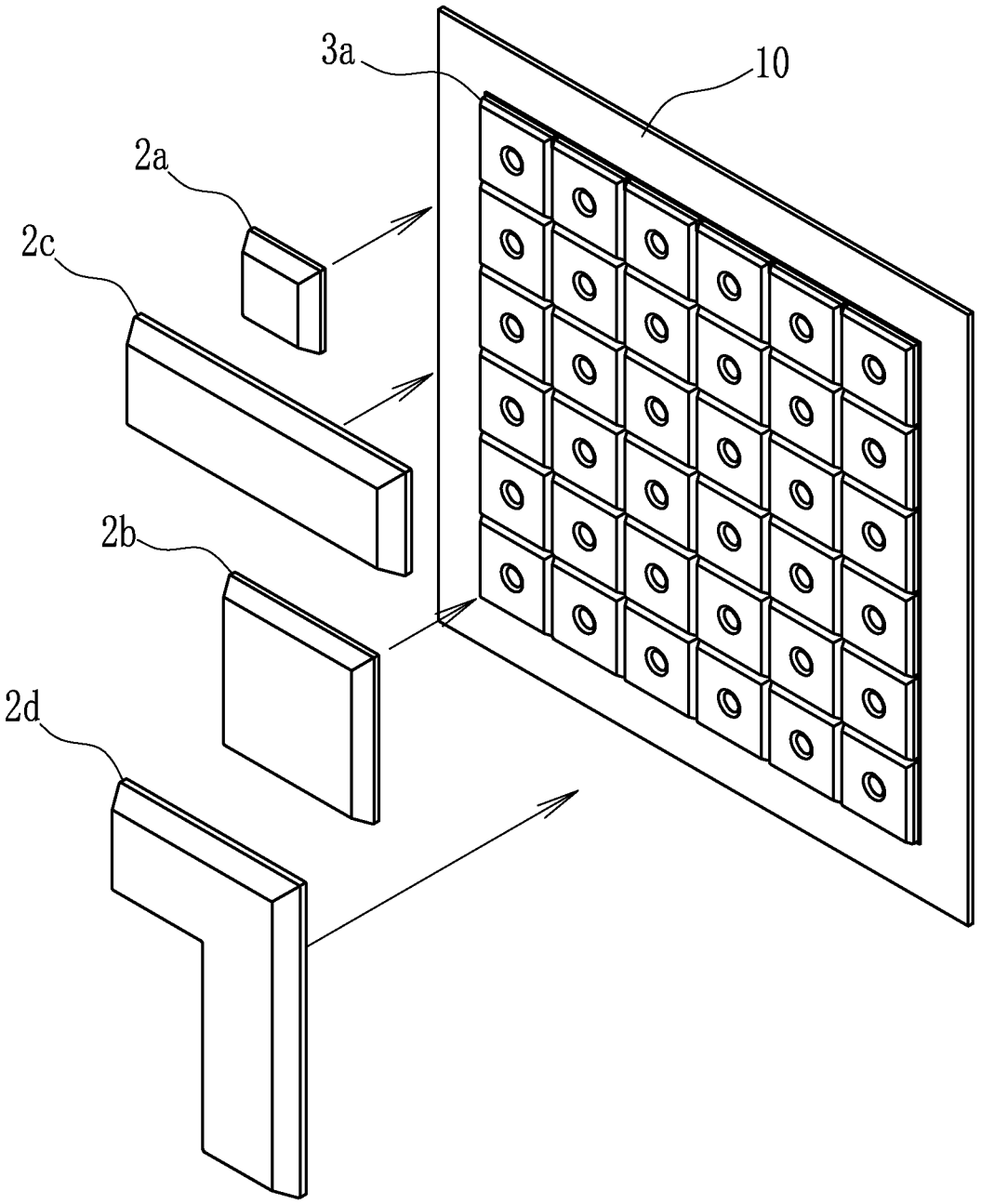
FIG. 8 is a perspective view of attachments immediately after installed on the wall according to the embodiment of the present disclosure.
Figure 9:
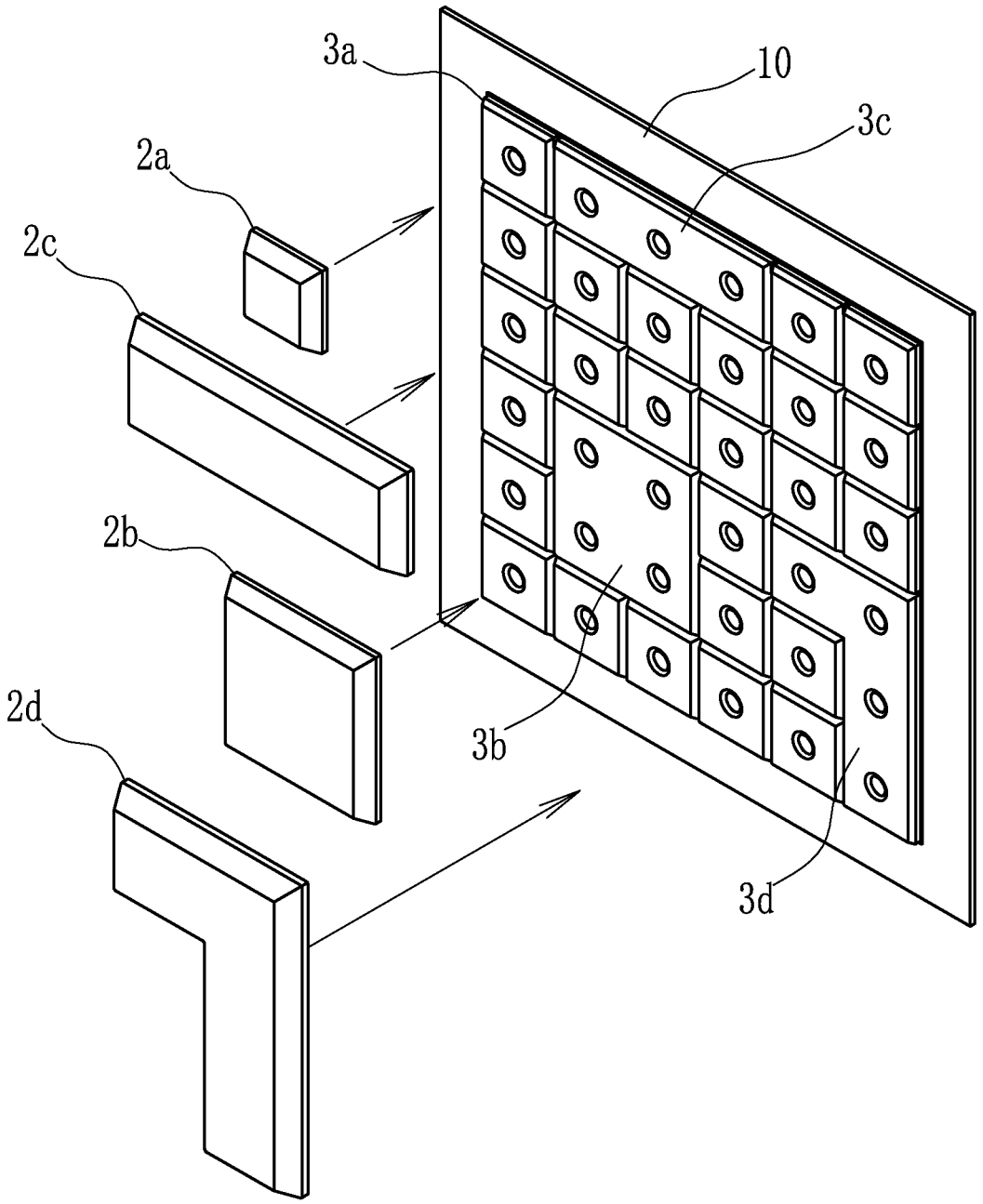
FIG. 9 is a perspective view illustrating another example of the attachments immediately after installed on the wall according to the embodiment of the present disclosure.

FIG. 8 is a perspective view of attachments immediately after installed on the wall 10. All the attachments installed on the wall 10 are attachments 3*a*, each of which is a one-fold attachment. The attachments 3*a* are arranged lengthwise and widthwise side by side. The consecutive attachments 3*a* are slightly spaced apart from each other so that the covers 2*a* or the like can be attached. FIG. 9 is a perspective view illustrating another example of the attachments immediately after installed on the wall 10. In FIG. 9, not only the attachments 3*a*, which are one-fold attachments, but also the integer-fold attachments 3*b* to 3*d* illustrated in FIG. 5 are installed on the wall 10.

In FIG. 8, the one-fold cover 2*a* can be attached to one attachment 3*a*. The integer-fold covers 2*b* to 2*d* can be attached to integer numbers of consecutive attachments 3*a*. Furthermore, when integer-fold attachments 3*b* to 3*d* are installed as illustrated in FIG. 9, integer-fold covers 2*b* to 2*d* having corresponding sizes can be attached to the integer-fold attachments 3*b* to 3*d*.

That is, with the design material set according to this embodiment, once attachments are attached to the target surface, not only one-fold covers but also integer-fold covers of different integer-fold numbers can be attached to the attachments, the flexibility of the correspondence between the attachments and the covers increases, and the variations of the design pattern formed by a plurality of covers increase.

Since the one-fold attachment is not the only attachment, and integer-fold attachments are installed on the target surface depending on the planed design pattern, the number of attachments can be reduced, and the efficiency of operation is improved.

Figure 10:
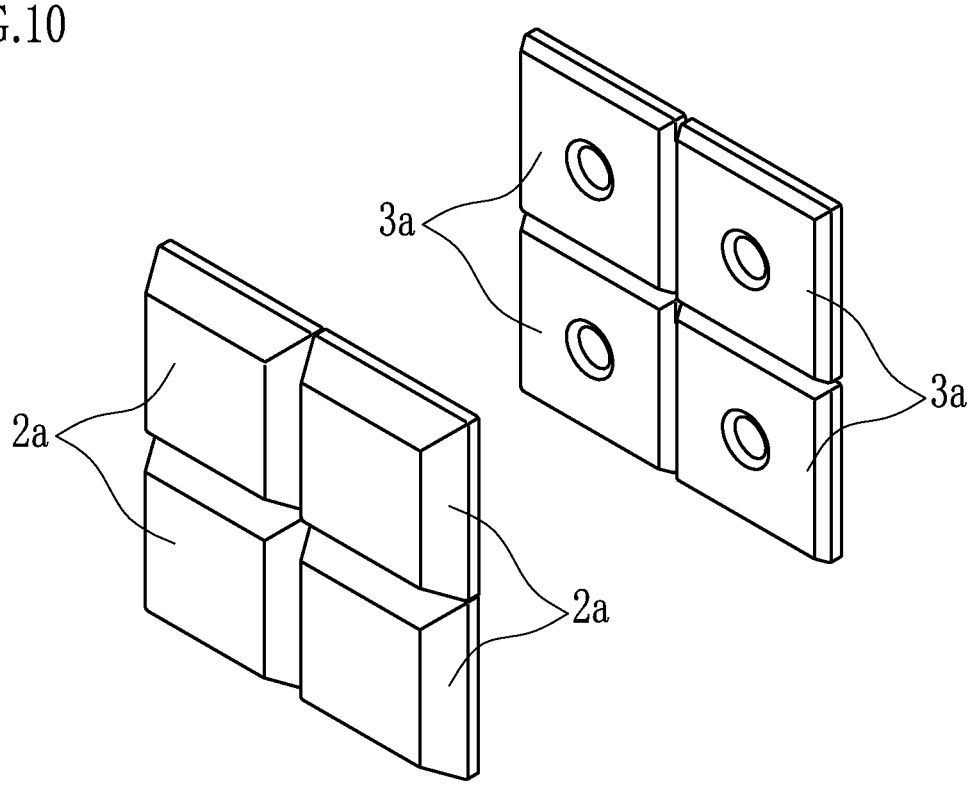
FIG. 10 is a perspective view illustrating a first example in which covers are attached to four attachments according to the embodiment of the present disclosure.

A variation of the design pattern will be described with regard to the area in which the integer-fold cover 2*b* of the four-fold number in FIG. 2 is attached. In FIG. 2, in the area in which the integer-fold cover 2*b* is attached, four one-fold attachments 3*a* are arranged in a rectangle configuration. FIG. 10 is a perspective view illustrating an example in which four one-fold covers 2*a* are attached to four one-fold attachments 3*a*. This drawing illustrates a state immediately before the integer-fold cover 2*b* is removed and four one-fold covers 2*a* are attached in place of the integer-fold cover 2*b* in FIG. 1. The area of the four one-fold attachments 3*a* is four times larger than that of the one-fold cover 2*a*, and four one-fold covers 2*a* can be attached as illustrated in FIG. 10.

Figure 11:
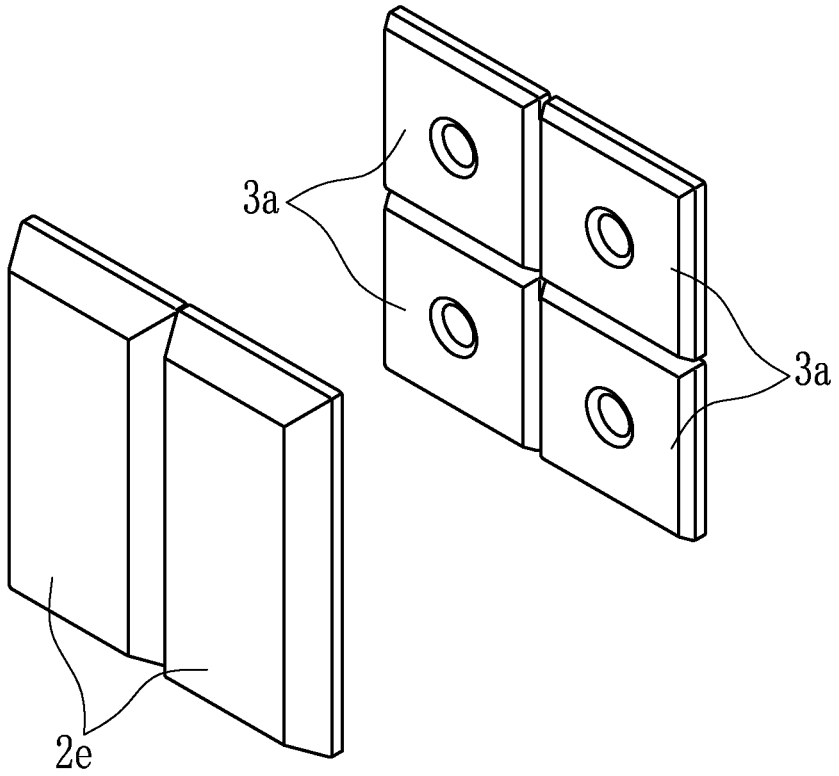
FIG. 11 is a perspective view illustrating a second example in which covers are attached to four attachments according to the embodiment of the present disclosure.
Figure 12:
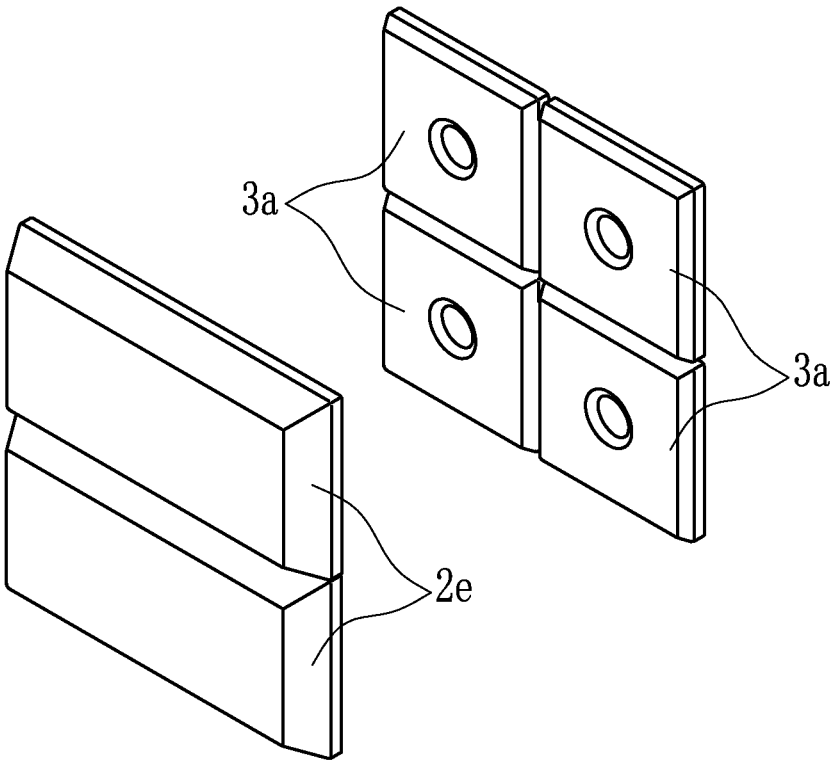
FIG. 12 is a perspective view illustrating a third example in which covers are attached to four attachments according to the embodiment of the present disclosure.

FIG. 11 is a perspective view illustrating an example in which the integer-fold covers 2*e* of the two-fold number are attached to four one-fold attachments 3*a*. The area of the four one-fold attachments 3*a* is twice larger than that of the integer-fold cover 2*e* of the two-fold number, and two integer-fold covers 2*e* can be attached as illustrated in FIG. 11. FIG. 12 is a perspective view illustrating another example in which the integer-fold covers 2*e* of the two-fold number are attached to four attachments 3*a*. While FIG. 11 illustrates an example in which the integer-fold covers 2*e* are arranged lengthwise, FIG. 12 illustrates an example in which the integer-fold covers 2*e* are arranged widthwise.

Figure 13:
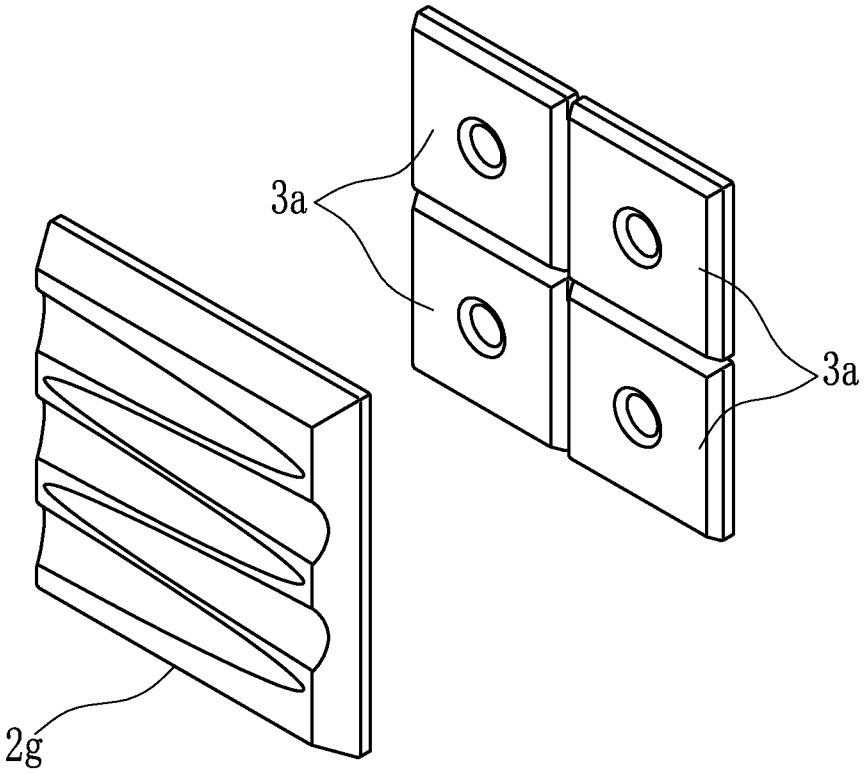
FIG. 13 is a perspective view illustrating a fourth example in which a cover is attached to four attachments according to the embodiment of the present disclosure.
Figure 14:
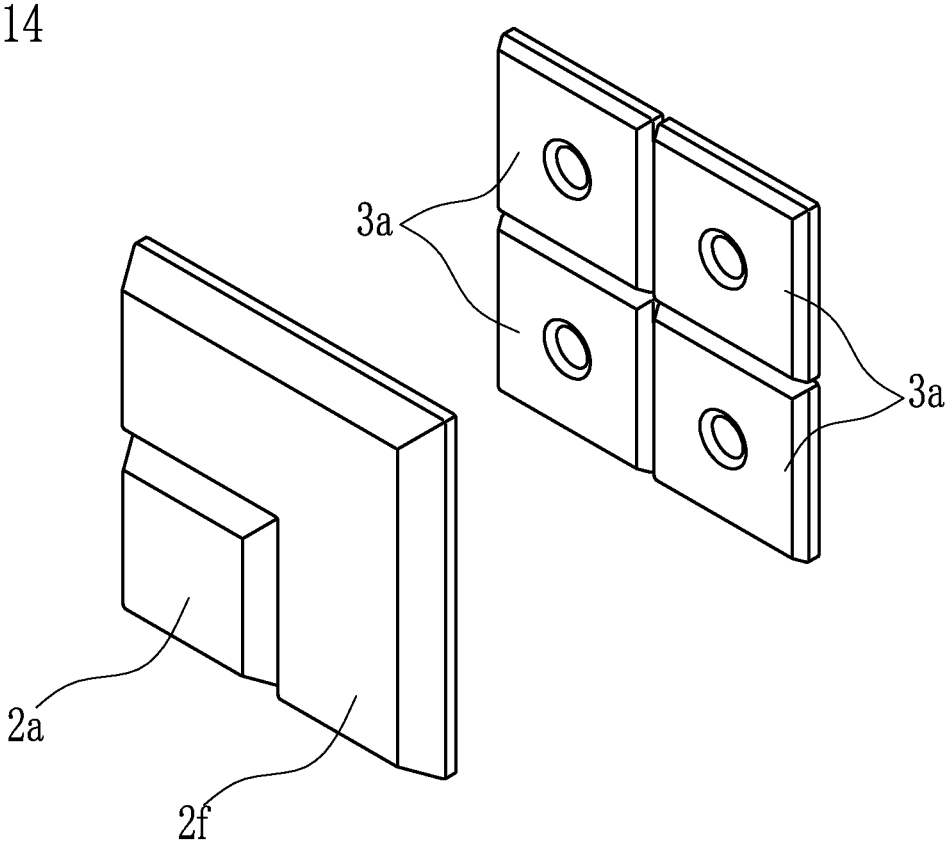
FIG. 14 is a perspective view illustrating a fifth example in which covers are attached to four attachments according to the embodiment of the present disclosure.

FIG. 13 is a perspective view illustrating another example in which an integer-fold cover 2*g* of the four-fold number is attached to four one-fold attachments 3*a*. Although a cover 2*g* has the same size as the integer-fold cover 2*b* illustrated in FIG. 1, the cover 2*g* differs from the integer-fold cover 2*b* in that the surface is embossed. The design pattern can be changed by replacing a cover with a cover having a differently embossed surface, even though the replacement cover has the same size as the original cover. The same effect can be attained by replacement with a cover having a different color. FIG. 14 is a perspective view illustrating an example in which the one-fold cover 2*a* and the integer-fold cover 2*f* of the three-fold number are attached to four one-fold attachments 3*a*.

Figure 15:
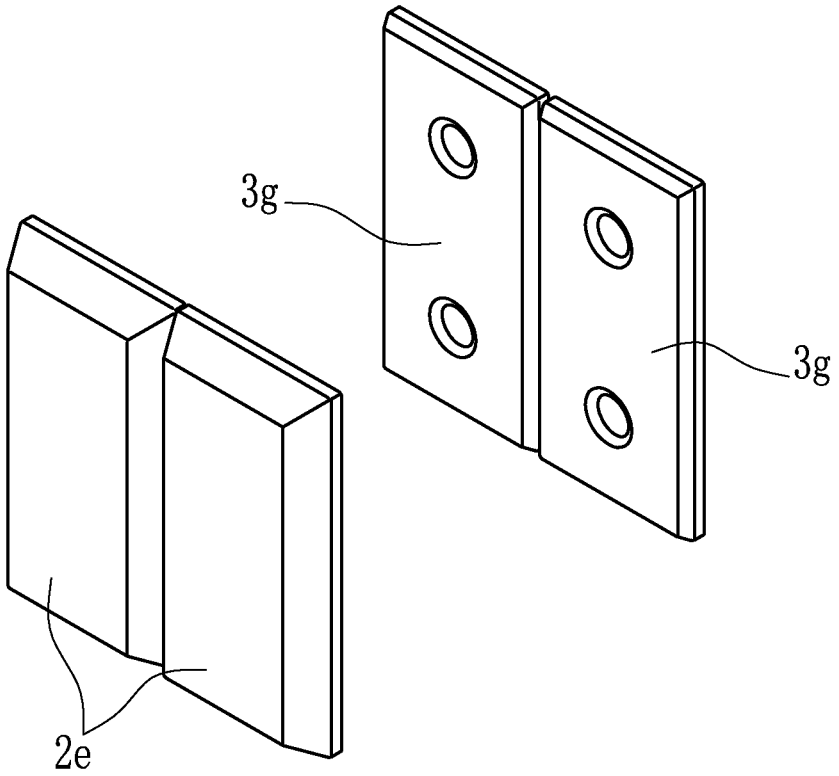
FIG. 15 is a perspective view illustrating a first example in which covers are attached in an area formed by integer-fold attachments according to the embodiment of the present disclosure.
Figure 16:
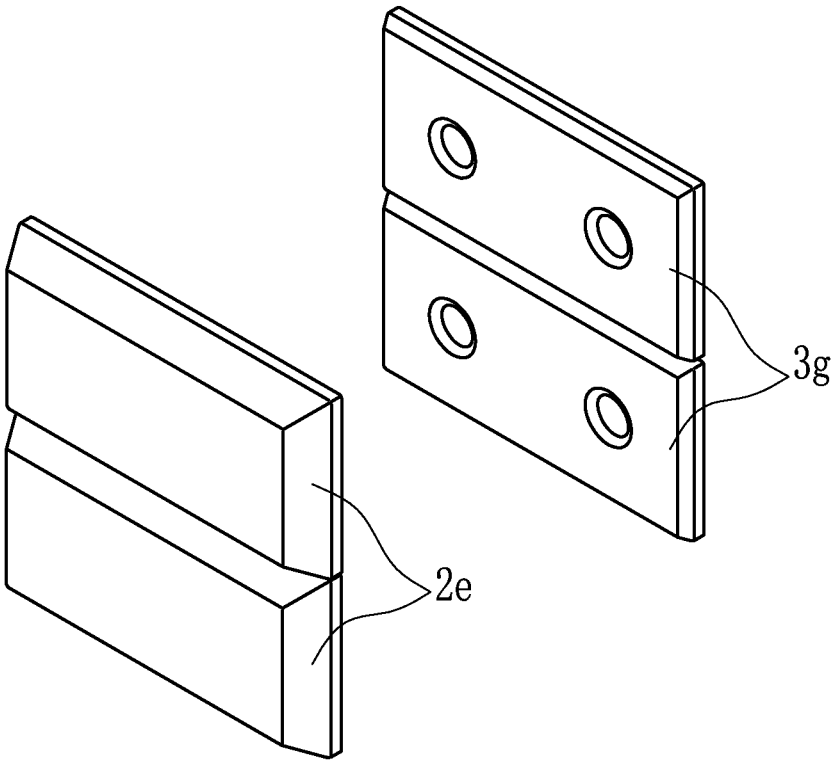
FIG. 16 is a perspective view illustrating a second example in which covers are attached in an area formed by integer-fold attachments according to the embodiment of the present disclosure.

In FIGS. 10 to 14, the area in which the covers are attached is an area formed by one-fold attachments 3*a*. However, the area in which the covers are attached may be an area formed by an integer-fold attachment. FIGS. 15 to 18 are perspective views illustrating examples in which one or more covers are attached in an area formed by one or more integer-fold attachments. In FIG. 15, two integer-fold attachments 3*g* of the two-fold number are arranged widthwise to form an attachment area for the integer-fold covers 2*e* of the two-fold number. In FIG. 16, two integer-fold attachments 3*g* of the two-fold number are arranged lengthwise to form an attachment area for the integer-fold covers 2*e* of the two-fold number.

Figure 17:
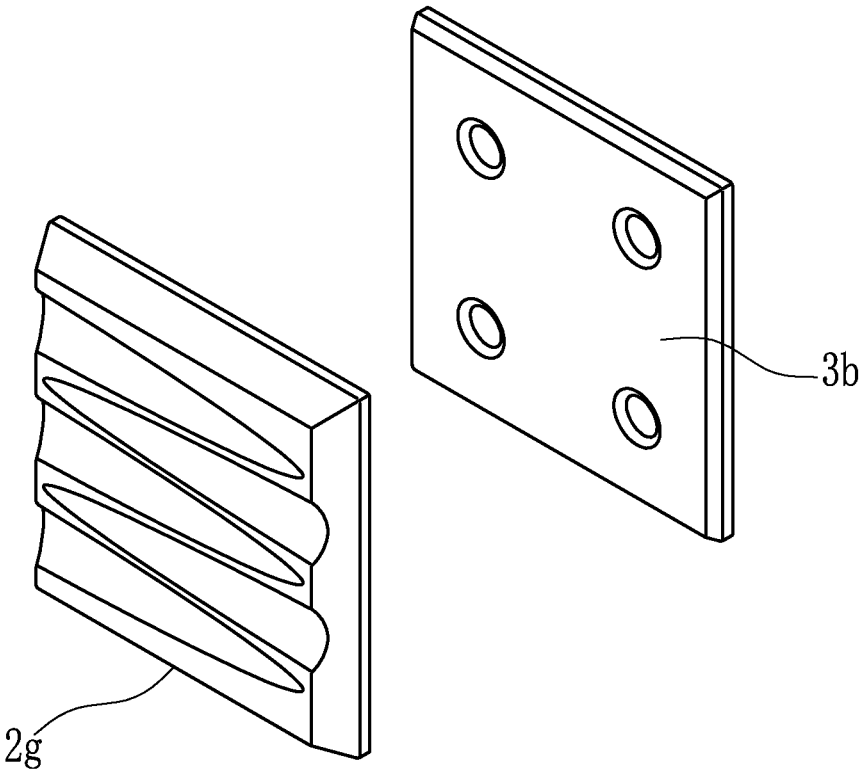
FIG. 17 is a perspective view illustrating a third example in which a cover is attached in an area formed by an integer-fold attachment according to the embodiment of the present disclosure.
Figure 18:
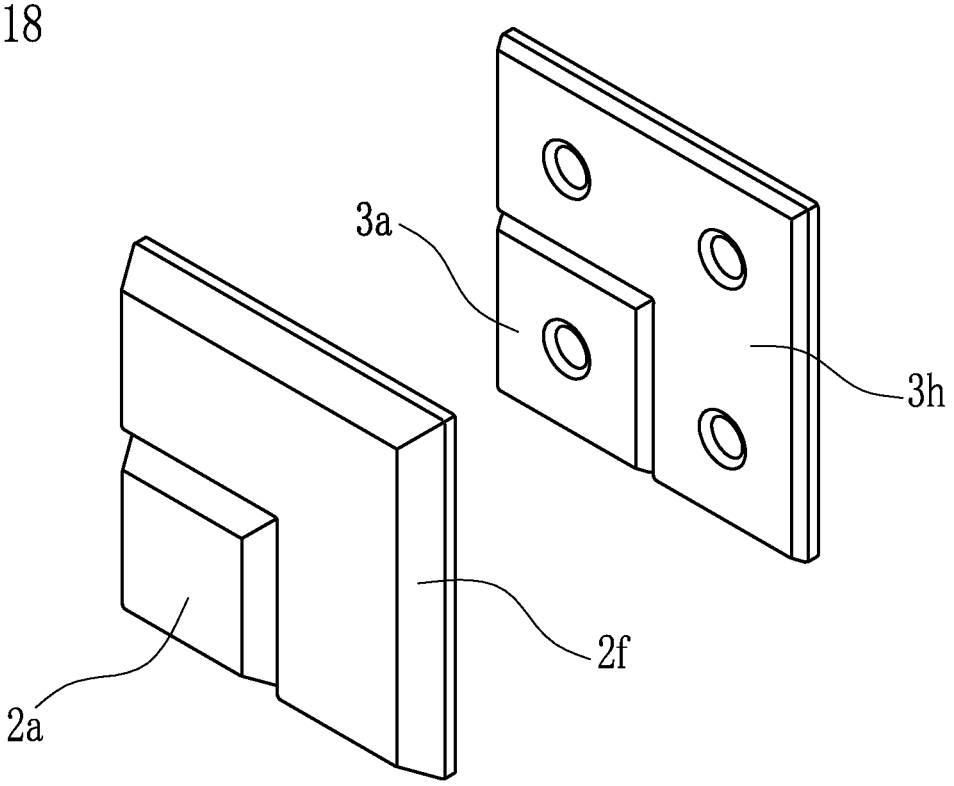
FIG. 18 is a perspective view illustrating a fourth example in which covers are attached in an area formed by integer-fold attachments according to the embodiment of the present disclosure.

In FIG. 17, an attachment area for the integer-fold covers 2*g* of the four-fold number is formed by the integer-fold attachment 3*b* of the four-fold number. In FIG. 18, an attachment area for the integer-fold covers 2*f* of the three-fold number and the one-fold cover 2*a* is formed by the integer-fold attachment 3*h* of the three-fold number and the one-fold attachment 3*a*.

As described with reference to FIGS. 10 to 14, to four attachments 3*a*, one-fold covers can be attached, integer-fold covers of different, two to four, integer-fold numbers can be attached, such integer-fold covers can be attached in different orientations, both one-fold covers and integer-fold covers can be attached, or covers having differently embossed surfaces can be attached, so that the design pattern can be changed in a wide variety of ways. As described with reference to FIGS. 15 to 18, installing an integer-fold attachment allows attachment of a cover corresponding to the integer-fold number of the integer-fold attachment, so that the number of attachments can be reduced.

If the number of attachments is increased to widen the target area, the variations of the arrangement increase, and integer-fold attachments and integer-fold covers of a greater integer-fold number can be attached, so that the variations of the design pattern further increase. By attaching integer-fold covers that are of the same integer-fold number but have different shapes (see the covers 2*b* and 2*d* in FIG. 9), the variations of the design pattern further increase.

Figure 19:
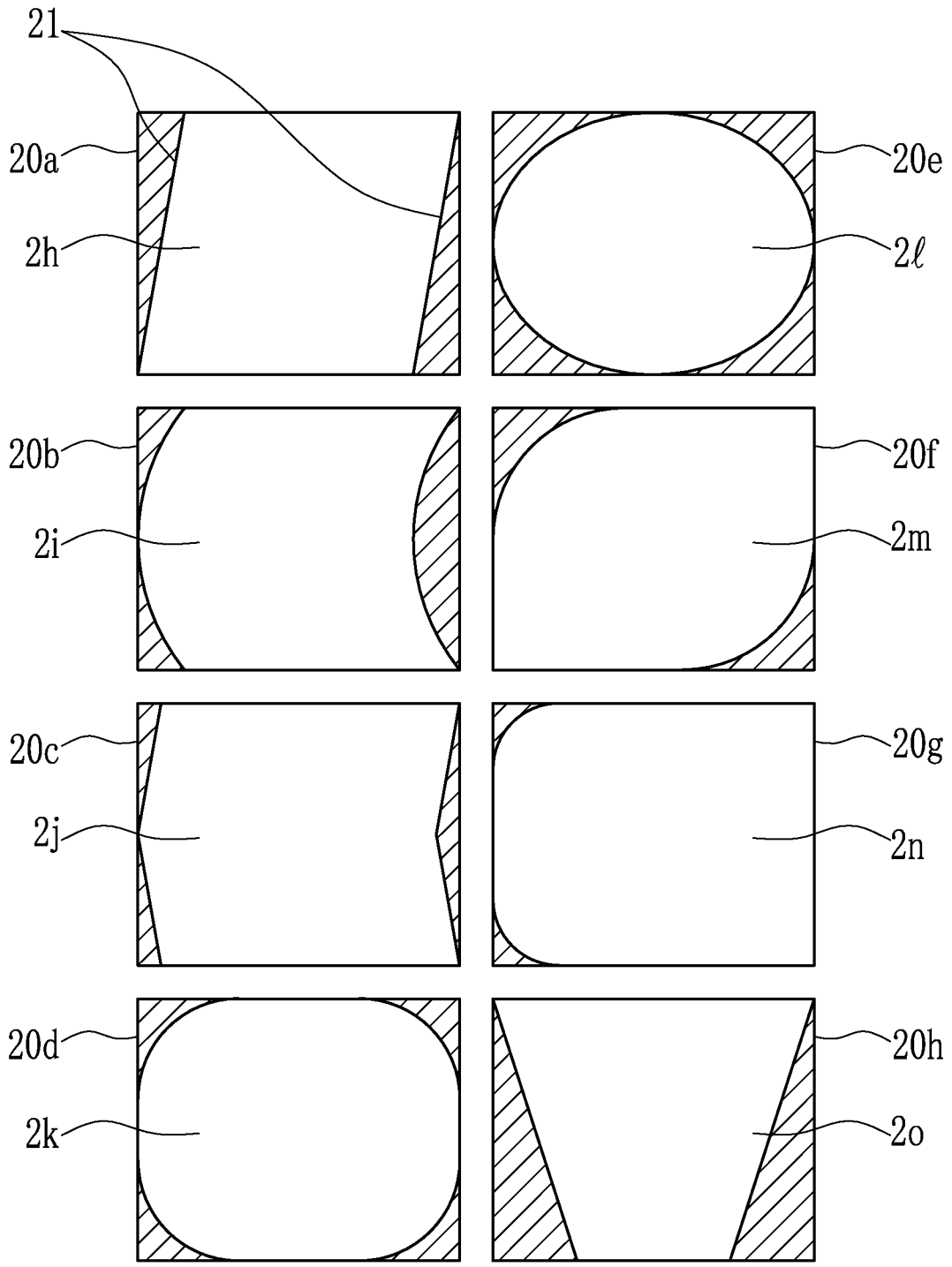
FIG. 19 is a plan view illustrating examples of a one-fold cover according to the embodiment of the present disclosure.

Although this embodiment has been described with regard to examples in which the shape of the cover 2*a*, which is a one-fold cover, in plan view is a rectangle, the present disclosure is not limited to this. FIG. 19 illustrates various example shapes of the one-fold cover. Although the shapes of one-fold covers 2*h* to 2*o* in plan view illustrated in FIG. 19 are all inscribed in a rectangle, the shape is not limited to those inscribed in a rectangle, and the cover can have any shape that allows the cover to be fitted onto the one-fold attachment.

The hatched parts in FIG. 19 are parts cut away from rectangles 20*a* to 20*h*, and the remainders after cutting these parts away from the rectangles 20*a* to 20*h* are the shapes of the one-fold covers 2*h* to 2*o* in plan view. Although the rectangles 20*a* to 20*h* in FIG. 19 have the same size, the size of the rectangles 20*a* to 20*h* can be arbitrarily determined, and the rectangles 20*a* to 20*h* may have different sizes.

The shapes of the one-fold attachments to be fitted to the one-fold covers 2*h* to 2*o* are to conform with the shapes of the one-fold covers 2*h* to 2*o*, respectively. For example, the one-fold attachment to be fitted to the cover 2*h* may have a rhombus shape fitted to the cover 2*h* along the entire inner circumference thereof or a rectangle or circle partially inscribed and fitted in the inner circumference of the cover 2*h*.

Figure 20:
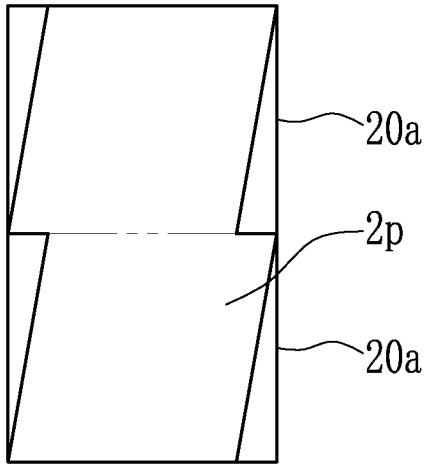
FIG. 20 is a plan view illustrating an example of an integer-fold cover of a two-fold number formed by covers **2*h* illustrated in FIG. 19**.

A plurality of each of the one-fold covers 2*h* to 2*o* can be arranged and integrated to form an integer-fold cover. FIG. 20 illustrates an integer-fold cover 2*p* of the two-fold number formed by the one-fold covers 2*h* illustrated in FIG. 19. The integer-fold cover 2*p* is formed by the one-fold covers 2*h* illustrated in FIG. 19 arranged lengthwise and integrated.

Figure 21:
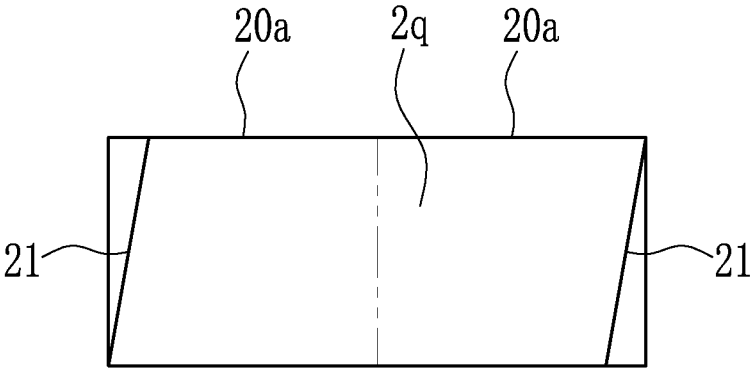
FIG. 21 is a plan view illustrating another example of the integer-fold cover of the two-fold number formed by covers **2*h* illustrated in FIG. 19**.

FIG. 21 illustrates another example of the integer-fold cover of the two-fold number formed by the one-fold covers 2*h* illustrated in FIG. 19. An integer-fold cover 2*q* illustrated in FIG. 21 is formed by the one-fold covers 2*h* arranged widthwise and integrated. Although the shape of the integer-fold cover 2*q* is based on the shape of the one-fold cover 2*h*, one of a pair of oblique sides 21 of one one-fold cover 2*h* illustrated in FIG. 19 is merged with one of the oblique sides 21 of the other one-fold cover 2*h*, so that the integrity is improved.

Figure 22:
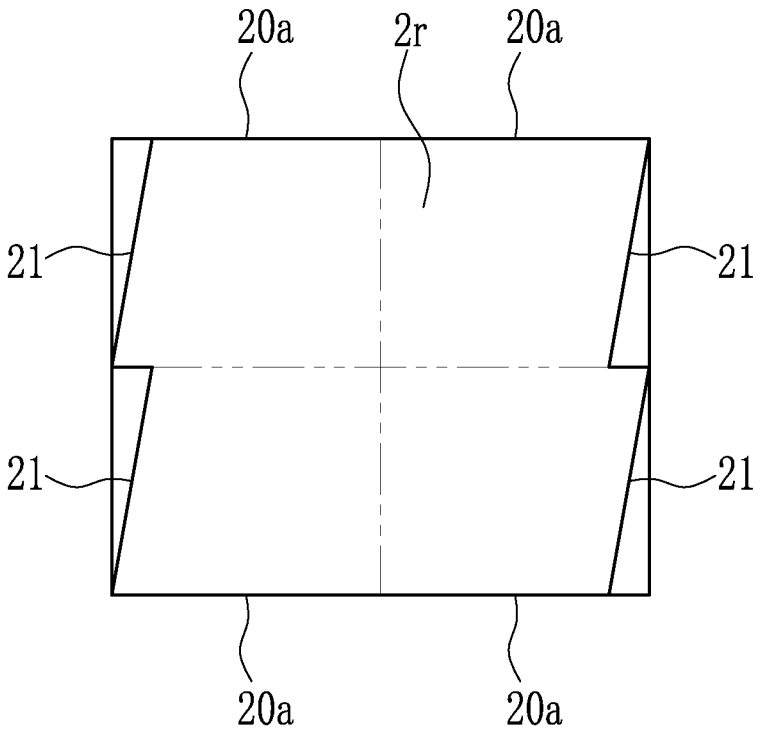
FIG. 22 is a plan view illustrating an example of an integer-fold cover of a four-fold number formed by covers **2*h* illustrated in FIG. 19**.

FIG. 22 illustrates an example of an integer-fold cover of the four-fold number formed by the one-fold covers 2*h* illustrated in FIG. 19. An integer-fold cover 2*r* illustrated in FIG. 22 is formed by the one-fold covers 2*h* arranged lengthwise and widthwise and integrated. Although the shape of the integer-fold cover 2*r* is based on the shape of the one-fold cover 2*h*, one of the pair of oblique sides 21 of each one-fold cover 2*h* illustrated in FIG. 19 is merged with one of the oblique sides 21 of the adjacent one-fold cover 2*h*, so that the integrity is improved.

Figure 23:
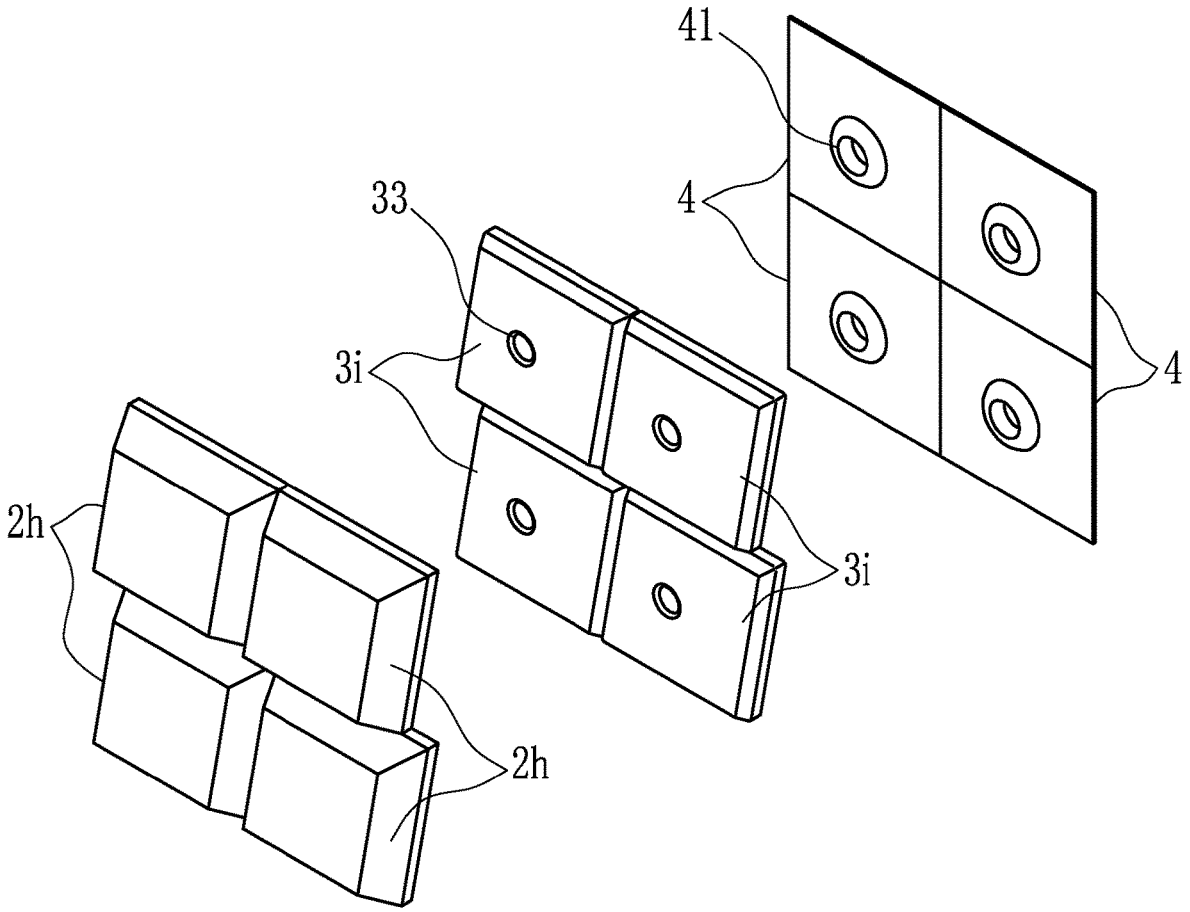
FIG. 23 is a perspective view illustrating an example in which four one-fold covers are attached to four one-fold attachments according to the embodiment of the present disclosure.

FIG. 23 is a perspective view illustrating an example in which four one-fold covers 2*h* are attached to four one-fold attachments 3*i*. The shape of the one-fold attachment 3*i* in plan view is a rhombus shape fitted to the cover 2*h* along the entire inner circumference thereof. The projection 33 of the one-fold attachment 3*i* is fitted into the recess 41 of the substrate 4, and the one-fold attachment 3*i* and the substrate 4 are fixed by the frictional force between the members fitted to each other (see FIGS. 3 and 4).

Figure 24:
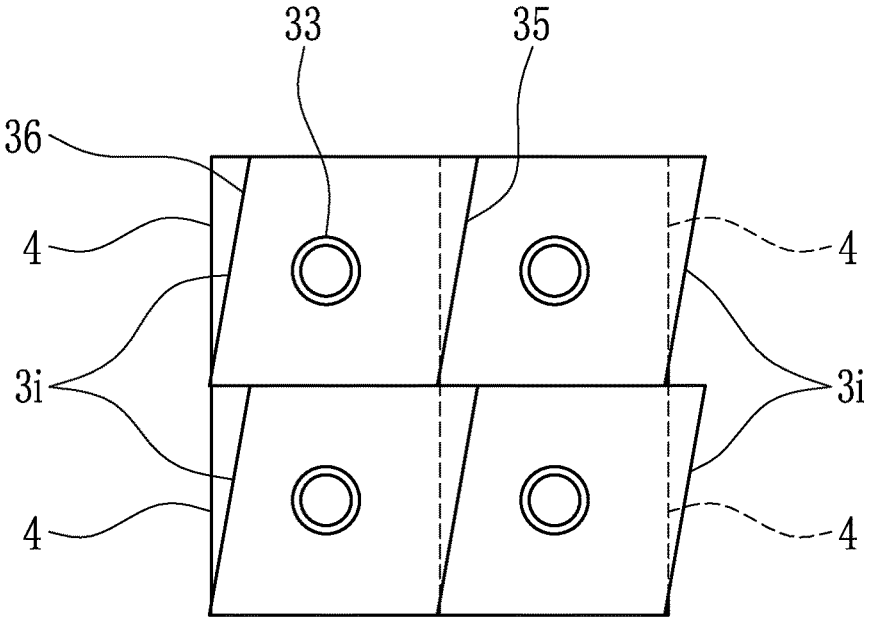
FIG. 24 is a plan view of the one-fold attachments illustrated in FIG. 23 attached to the substrates.

FIG. 24 is a plan view of the one-fold attachments 3*i* attached to the substrates 4. Although adjacent attachments 3*i* are shown as being in contact with each other for the convenience of illustration, the adjacent attachments 3*i* are slightly spaced apart from each other so that the covers 2*h* can be attached. The substrate 4 has the same size as the substrate 4 illustrated in FIG. 2, which can be used with the rectangular cover 2*a* and the like. As illustrated in FIG. 24, when the one-fold attachment 3*i* having a rhombus shape is attached to the substrate 4, the one-fold attachment 3*i* having a rhombus shape partially extends off the substrate 4 on the side of a side 35. However, the one-fold attachment 3*i* leaves a margin on the side of a side 36, so that the one-fold attachment 3*i* having a rhombus shape can also be attached to the substrate 4.

The one-fold attachment attached to the cover 2*h* may have a rectangular shape that is inscribed and fitted in the inner circumference of the cover 2*h*. In that case, the rectangular shape is smaller than the rectangle 30 constituting the outer circumference of the one-fold attachment 3*a* illustrated in FIG. 2 and is smaller than one substrate 4, so that the one-fold attachment of the rectangular shape can be attached to the substrate 4.

Figure 27:
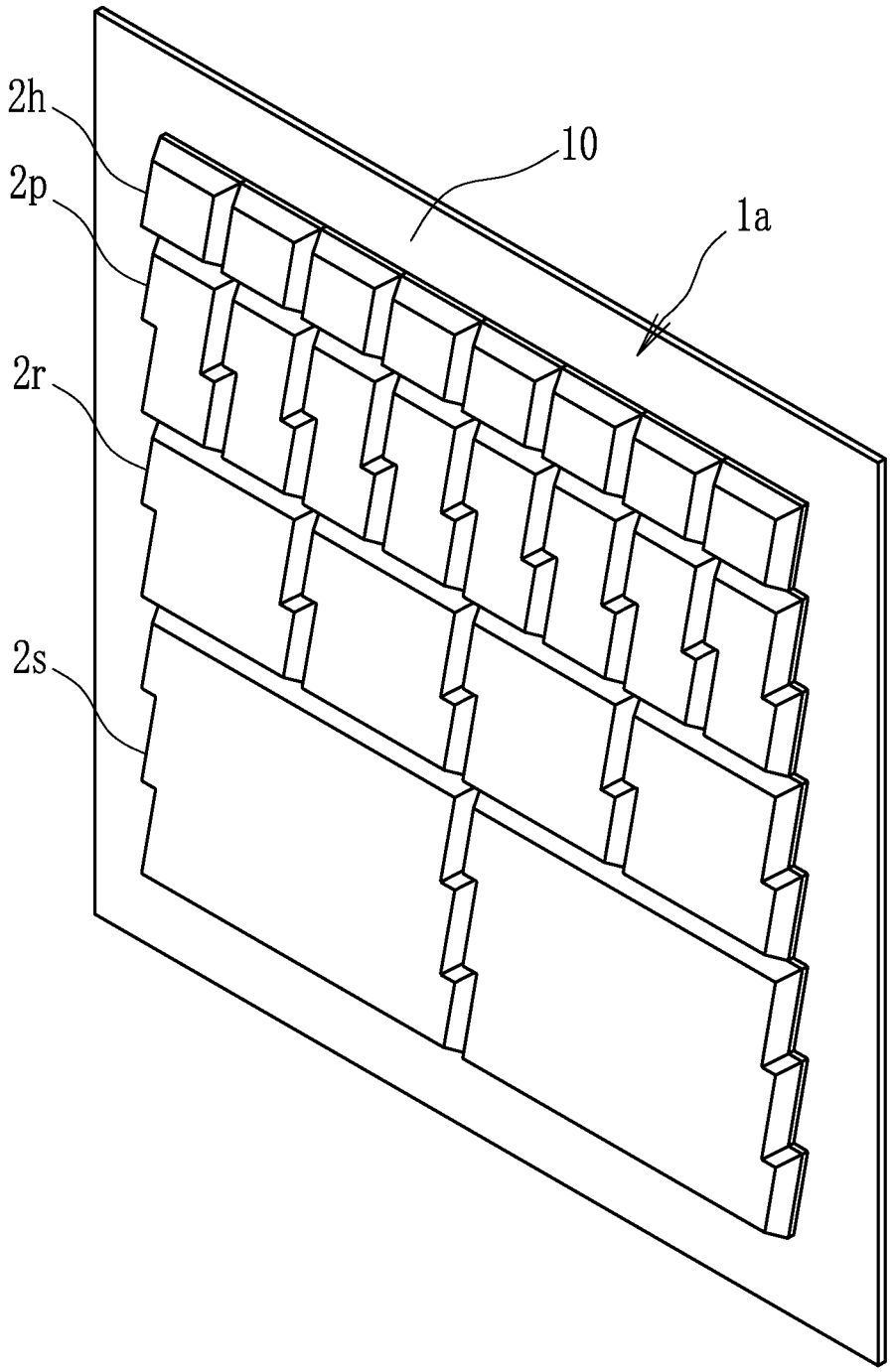
FIG. 27 is a perspective view of a design material set according to the embodiment of the present disclosure installed on the wall.

That is, once the substrates 4 are installed on the wall 10 as illustrated in FIG. 2, the one-fold cover 2*h* having a rhombus shape or the integer-fold cover 2*p*, 2*q*, 2*r* or 2*s* formed by an integer number of one-fold covers 2*h* can be attached by changing the attachments attached to the substrates 4 as required, while maintaining the installed substrates 4 (see FIG. 27). The same holds true for the covers 2*i* to 2*o* illustrated in FIG. 19.

Figure 25:
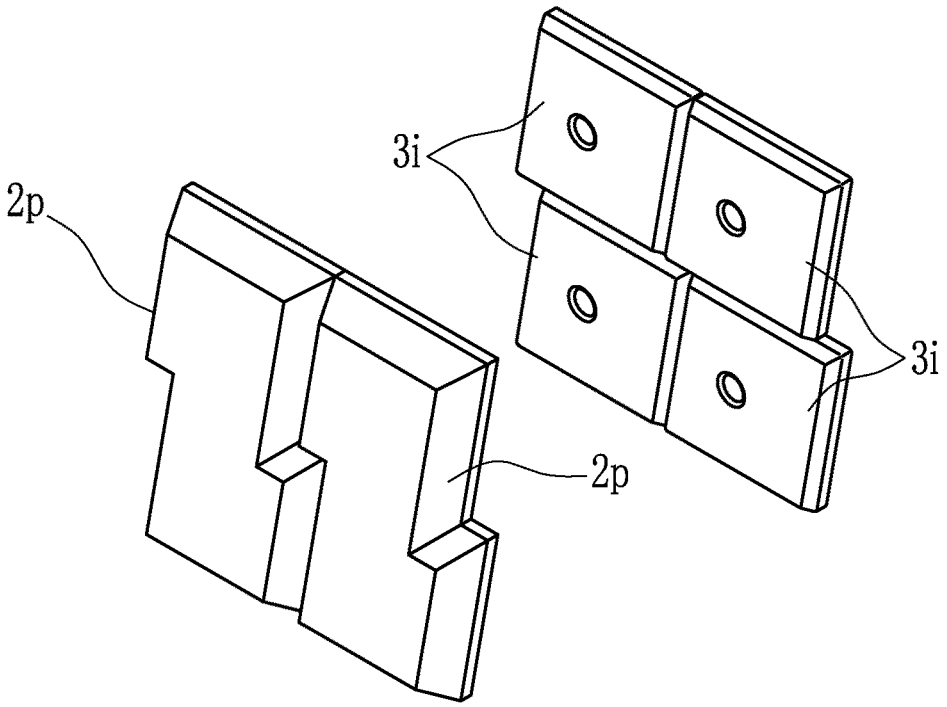
FIG. 25 is a perspective view illustrating an example in which integer-fold covers of the two-fold number are attached to four attachments according to the embodiment of the present disclosure.
Figure 26:
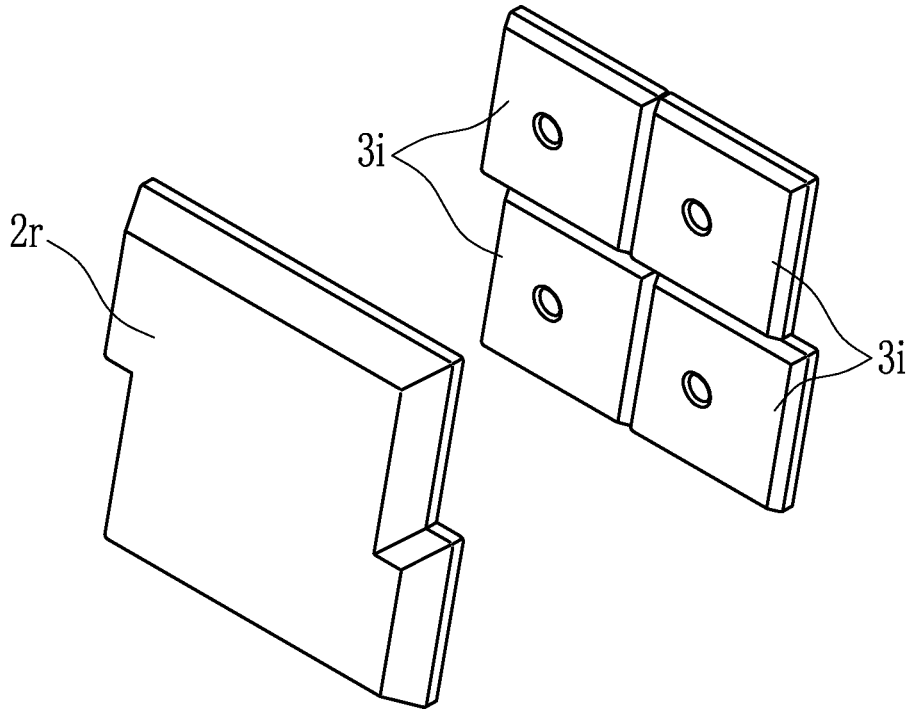
FIG. 26 is a perspective view illustrating an example in which an integer-fold cover of the four-fold number is attached to four attachments according to the embodiment of the present disclosure.

FIG. 25 is a perspective view illustrating an example in which integer-fold covers 2*p* of the two-fold number are attached to four attachments 3*i*. As illustrated in FIG. 25, two integer-fold covers 2*p* of the two-fold number can be attached to the area of the four attachments 3*i*. FIG. 26 is a perspective view illustrating an example in which the integer-fold cover 2*r* of the four-fold number is attached to four attachments 3*i*. As illustrated in FIG. 26, the integer-fold cover 2*r* of the four-fold number can be attached to the area of the four attachments 3*i*.

FIG. 27 is a perspective view of a design material set 1*a* including the cover 2*h* and the like installed on the wall 10. The design material set 1*a* includes a cover 2*s*, which is an integer-fold cover of a twelve-fold number, in addition to the covers 2*h* and the like illustrated in FIGS. 23 and 25 to 26. As in FIG. 1, the covers illustrated in FIG. 27 may be all the covers of the design material set 1*a*. However, the design material set 1*a* may additionally include the same covers as the covers 2*h* and the like, integer-fold covers of different integer-fold numbers, or integer-fold covers of the same integer-fold number having different outer shapes (such as the integer-fold cover 2*q* of the two-fold number illustrated in FIG. 21). When such various types of covers are additionally prepared, the design pattern can be changed by replacing a cover with any of the various covers additionally prepared, while the design pattern can be changed by removing and attaching the covers 2*h* or the like within the range of the already installed covers 2*h* and the like illustrated in FIG. 27. Therefore, the design pattern can be changed in a wider variety of ways.

Figure 28:
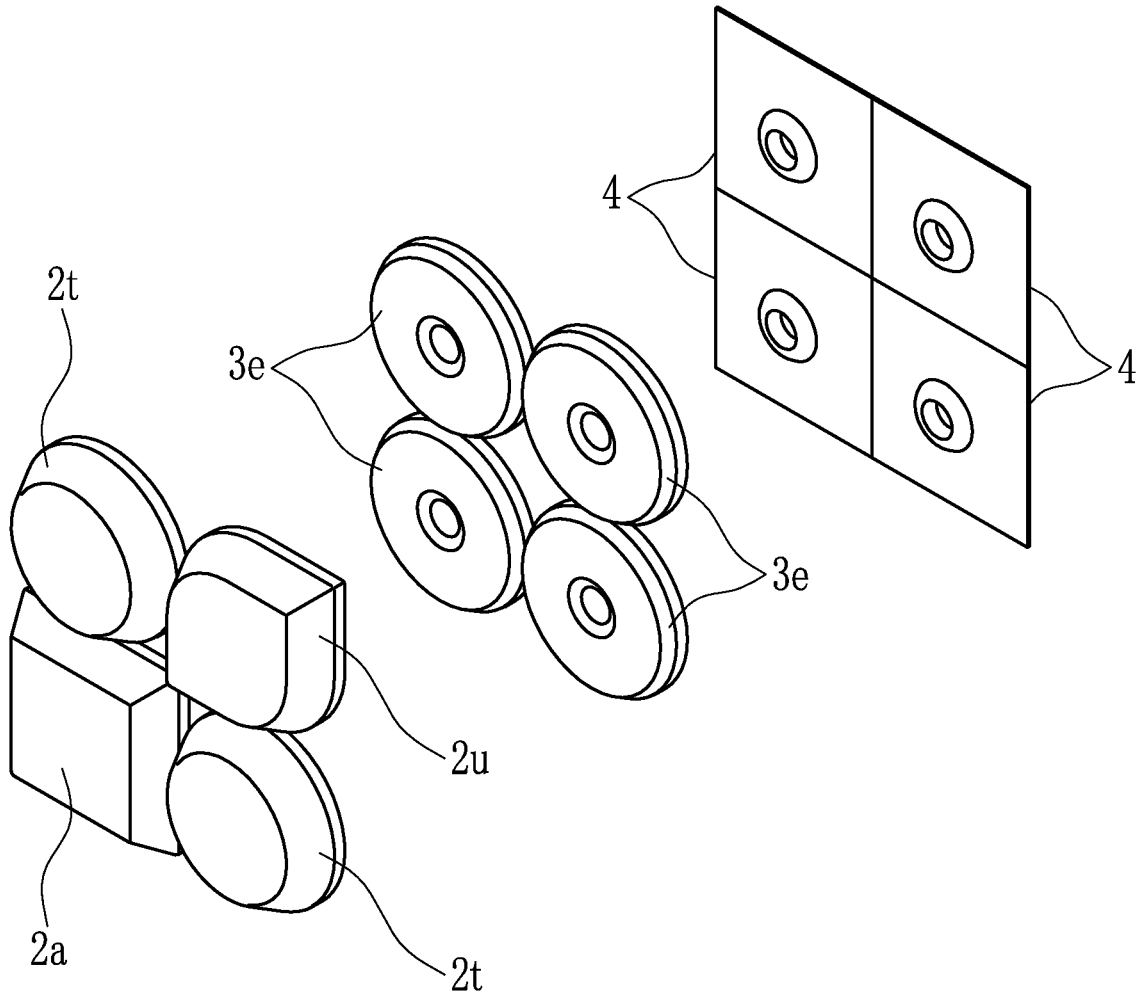
FIG. 28 is a perspective view illustrating another example of the attachment according to the embodiment of the present disclosure.

Although this embodiment has been described with regard to examples in which the shape of the attachment 3*a* in plan view is the rectangle 30 as illustrated in FIG. 2, for example, the present disclosure is not limited to this as described with reference to FIGS. 5 and 6. FIG. 28 is a perspective view illustrating another example of the attachment. The attachment 3*e* is the attachment illustrated in FIG. 6(*a*), and has a circular shape in plan view. To the circular attachment 3*e*, a cover 2*t* having a circular shape or a cover 2*u* having a curved contour can be attached. The circumferential surface is in contact with the four sides of the rectangle, so that the rectangular cover 2*a* can also be attached to the circular attachment 3*e*.

Figure 29:
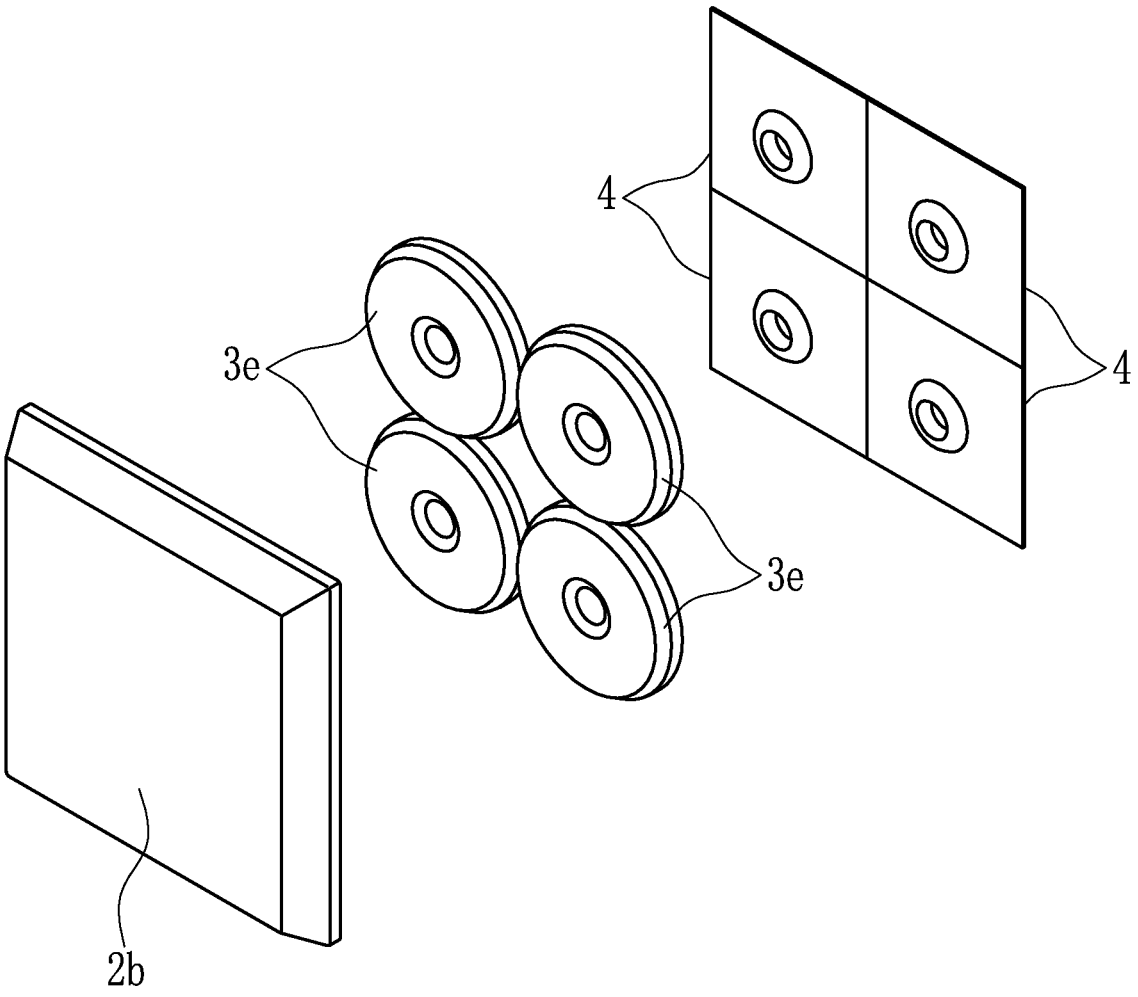
FIG. 29 is a perspective view illustrating an example in which another cover is attached to attachments illustrated in FIG. 28.

FIG. 29 is a perspective view illustrating an example in which another cover is attached to the attachments 3*e* illustrated in FIG. 28. In FIG. 29, the integer-fold cover 2*b* of the four-fold number is attached to four attachments 3*e*. In this case, the rectangular cover 2*b* is attached to the circular attachments 3*e* with the circumferential surface of each attachment 3*e* in contact with the corresponding one of the four surfaces forming the inner circumferential surface of the cover 2*b*.

Figure 30:
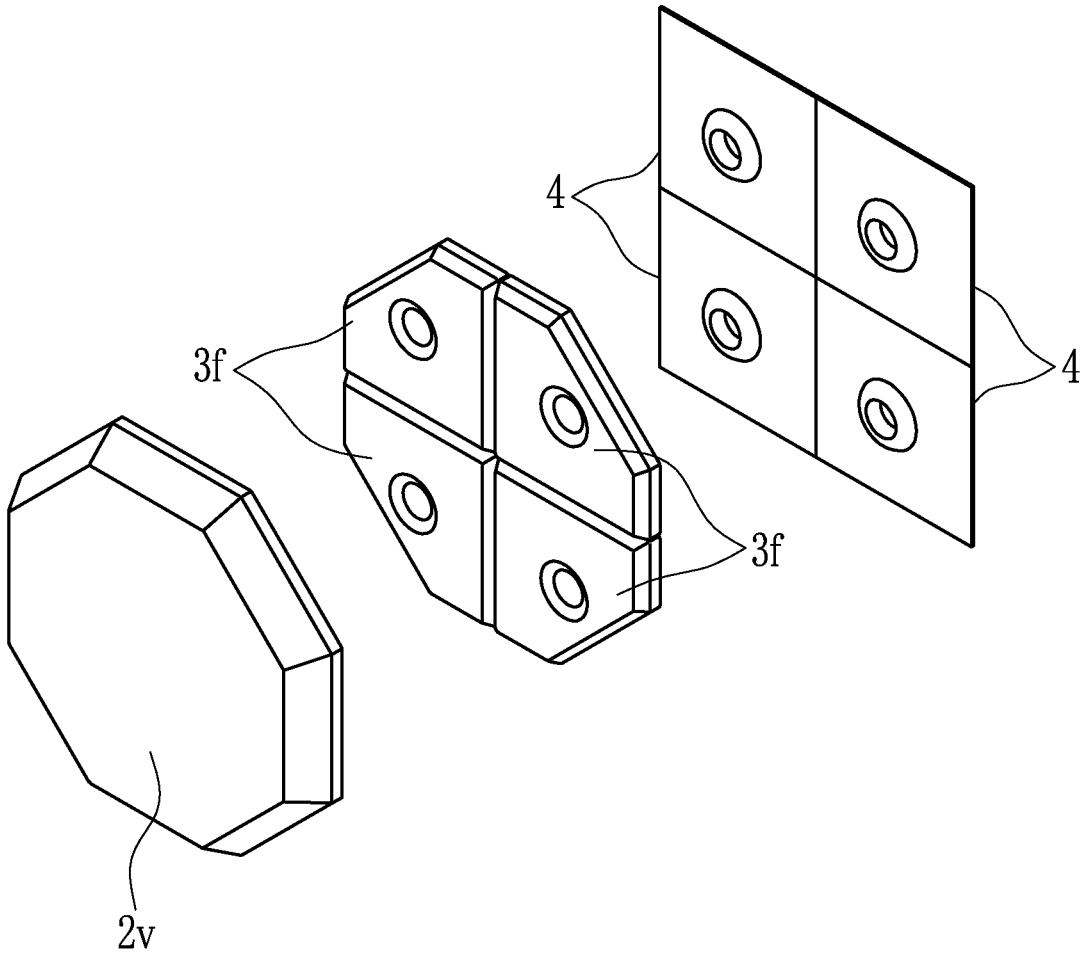
FIG. 30 is a perspective view illustrating another example of the attachment according to the embodiment of the present disclosure.

FIG. 30 is a perspective view illustrating yet another example of the attachment. The attachment 3*f* is the attachment illustrated in FIG. 6(*b*), and has a trapezoidal shape in plan view. The attachments 3*f* can form an octagonal outer shape, and a cover 2*v* having an octagonal shape can be attached. The octagon is a shape that is inscribed in a circle, a cover having a circular shape can also be attached to the attachments 3*f* forming an octagonal shape.

Figure 31:
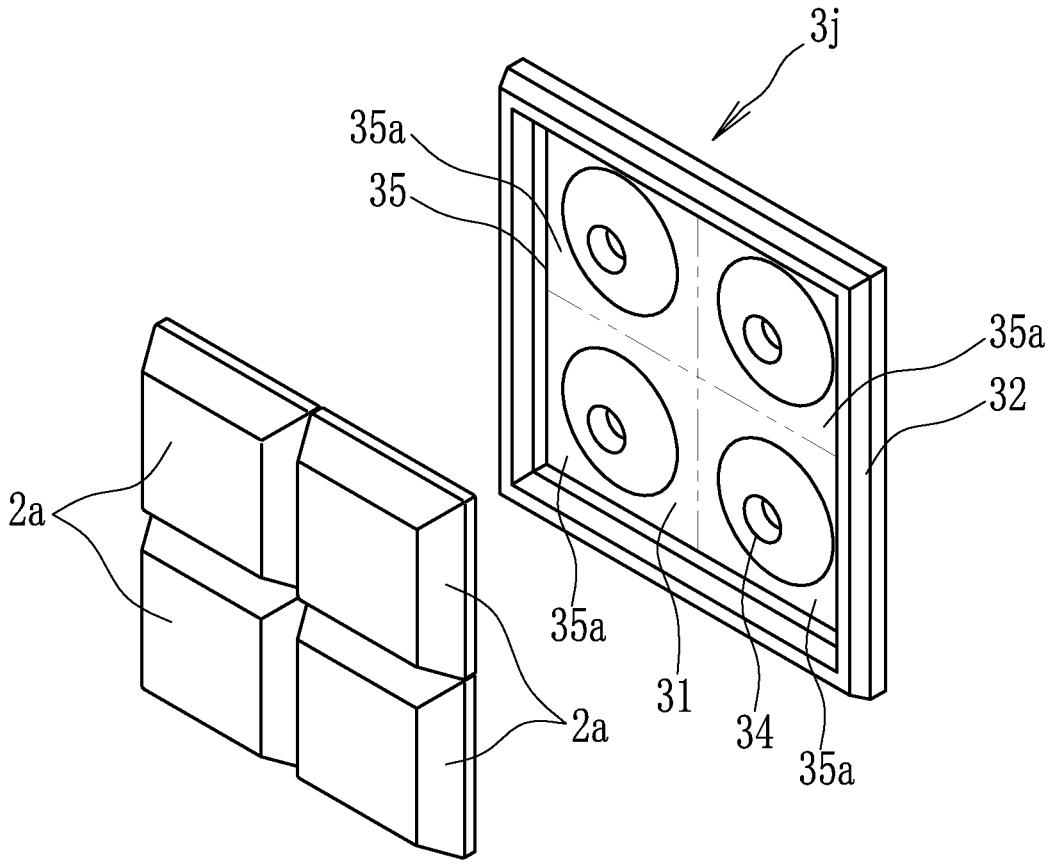
FIG. 31 is a perspective view of another example of the combination of an attachment and a cover according to the embodiment of the present disclosure.

Although, according to this embodiment, the attachment 3*a* and the cover 2*a* or the like are fitted to each other with the outer circumferential surface of the attachment 3*a* fitted into the inner circumferential surface of the cover 2*a* or the like as illustrated in FIGS. 3 and 4, the present disclosure is not limited to this. FIGS. 31 to 34 are perspective views illustrating other examples of the combination of the attachment and the cover. FIG. 31 is a perspective view of an attachment 3*j* and a cover 2*a* opposed to each other. The attachment 3*j* has a base 31 having a rectangular shape and a side wall 32 standing along the four sides of the outer circumference of the base 31 and surrounding the base 31.

In FIG. 31, the shape of a part of the attachment 3*j* facing the cover 2*a* in plan view is a rectangle 35 defined by the outer circumference of the base 31. The rectangle 35 is formed by four rectangles 35*a* arranged lengthwise and widthwise side by side, and the attachment 3*j* is an integer-fold attachment of the four-fold number. Although FIGS. 31 to 34 illustrate the attachment 3*j* that is an integer-fold attachment of the four-fold number, the one-fold attachment or integer-fold attachments of other integer-fold numbers can also be used.

Figure 32:
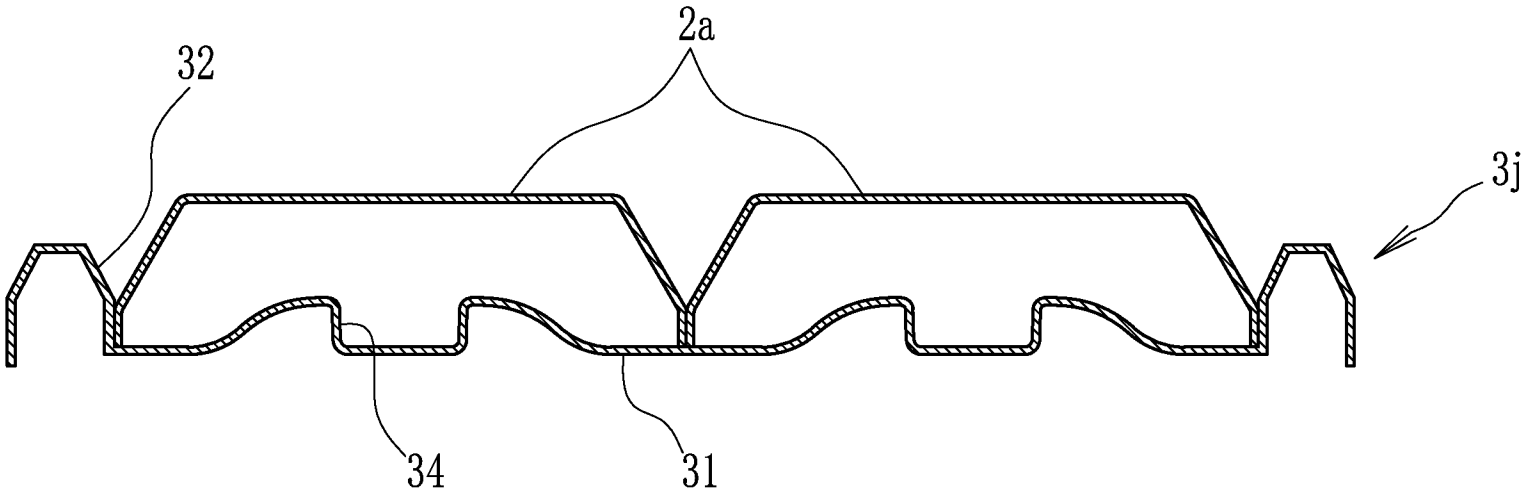
FIG. 32 is a cross-sectional view of the cover attached to the attachment illustrated in FIG. 31.

FIG. 32 is a cross-sectional view of the cover 2*a* attached to the attachment 3*j*. The outer circumferential surface of the cover 2*a* is fitted in the inner circumferential surface of the side wall 32, and the outer circumferential surfaces of the adjacent covers 2*a* are in contact with each other. As a result, the four covers 2*a* can be fixed to the attachment 3*j* by the frictional force therebetween.

As illustrated in FIG. 32, the attachment 3*a* illustrated in FIGS. 2 and 3 need not be interposed between the attachment 3*j* and the cover 2*a*. However, the attachment 3*a* may be interposed. In that case, the projection 33 of the attachment 3*a* illustrated in FIG. 3 is fitted into the recess 34 of the base 31 illustrated in FIG. 32.

Figure 33:
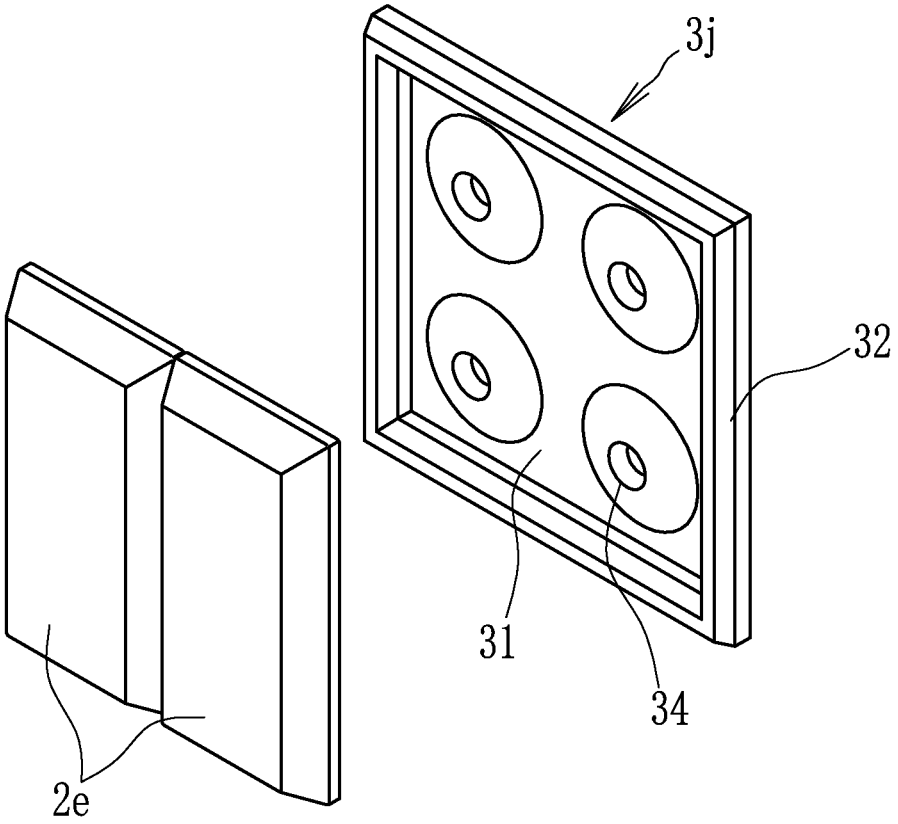
FIG. 33 is a perspective view illustrating a second example of the combination of the attachment illustrated in FIG. 31 and covers.
Figure 34:
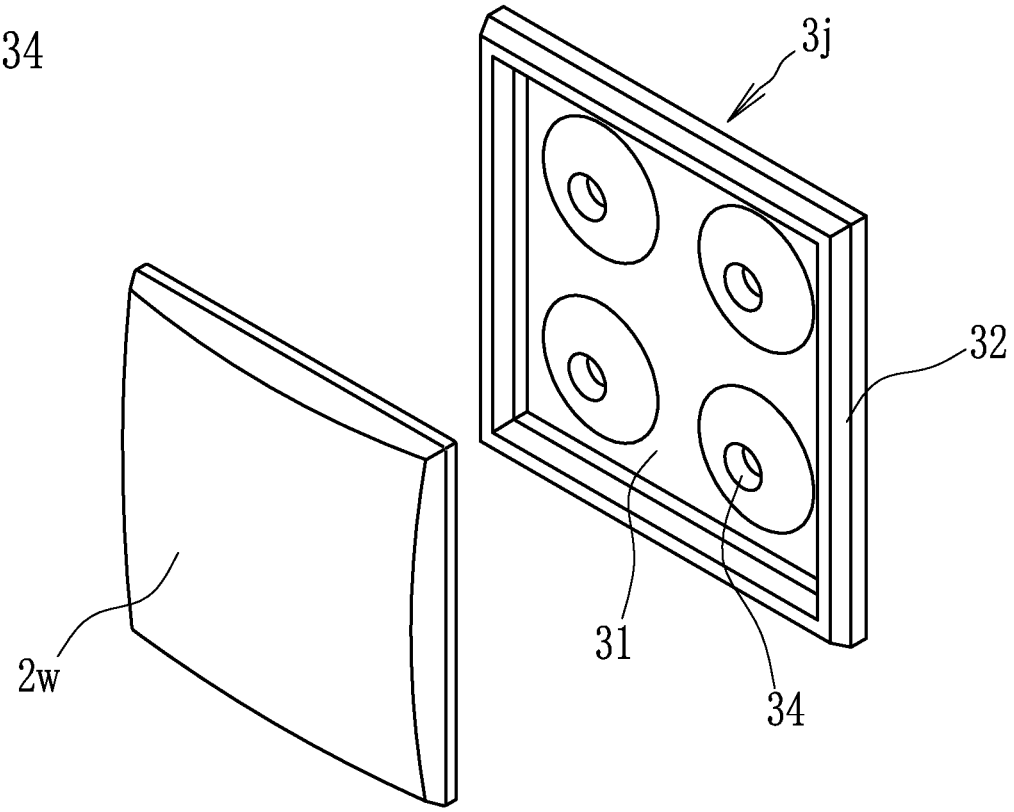
FIG. 34 is a perspective view illustrating a third example of the combination of the attachment illustrated in FIG. 31 and a cover.

In FIG. 31, some or all of the four covers 2*a* may be replaced with an integer-fold cover. FIG. 33 illustrates an example in which the integer-fold cover 2*e* of the two-fold number is attached to the attachment 3*j*, and FIG. 34 illustrates an example in which an integer-fold cover 2*w* of the four-fold number is attached to the attachment 3*j*.

Although an embodiment of the present disclosure has been described, the embodiment is an example and can be modified as required. For example, although the substrate 4 has a size corresponding to the one-fold cover 2*a* in FIG. 2, a large number of substrates 4 may be integrated to form a larger substrate. The covers have only to include at least integer-fold covers of different integer-fold numbers, and need not include the one-fold cover.

REFERENCE SIGNS LIST

1, la design material set
2*a*, 2*h*-2*o*, 2*t*, 2*u* one-fold cover
2*b*-2*g*, 2*p*-2*s*, 2*v*, 2*w* integer-fold cover

3*a*, 3*e*, 3*f*, 3*i* one-fold attachment
3*b*-3*d*, 3*g*, 3*h*, 3*j* integer-fold attachment
4 substrate
10 wall (target surface)
21, 31 base
30 rectangle
22, 32 side wall
11, 12 hollow part

What is claimed is:

1. A design material set that covers a target surface, the design material set comprising:

an attachment; and a cover to be attached to the attachment, wherein the attachment and the cover have a base and a side wall surrounding the base, the cover is capable of being attached to the attachment by fitting the side wall of the cover to the side wall of the attachment, a shape of a part of the attachment facing the cover in plan view is a one-fold shape, which is inscribed in a minimum unit rectangle, or an integer-fold shape, which is inscribed in sides of a shape formed by an integer number of the minimum unit rectangles arranged side by side, provided that an attachment of the one-fold shape is referred to as a one-fold attachment, and an attachment of the integer-fold shape is referred to as an integer-fold attachment, the design material set includes a plurality of covers, the covers including a one-fold cover, which has a size that allows the cover to be attached to the one-fold attachment, or an integer-fold cover, which has a size that allows the cover to be attached to the integer-fold attachment, and including at least integer-fold covers of different integer-fold numbers, when a plurality of attachments is arranged lengthwise and widthwise side by side on the target surface, a design pattern formed by a plurality of covers can be configured by attaching the one-fold cover to the one-fold attachment, attaching the integer-fold cover to an integer number of one-fold attachments, the integer number being equal to or greater than 2, or attaching the integer-fold cover to the integer-fold attachment, the design pattern can be changed by removing a cover from the attachment and attaching a new cover, or rearranging the covers, the design pattern can be changed by replacing the integer-fold cover attached to the attachment with an integer-fold cover of a different integer-fold number, and the design pattern can be changed by changing the orientation of the integer-fold cover attached to the attachment to a lengthwise orientation or a widthwise orientation, wherein attachment of the one-fold cover to the one-fold attachment is attained by friction between the one-fold cover and the one-fold attachment, and attachment of the integer-fold cover to the integer-fold attachment is attained by friction between the integer-fold cover and the integer-fold attachment, and wherein a hollow space is formed inside the one-fold cover when the one-fold cover is attached to the one-fold attachment, and a hollow space is formed inside the integer-fold cover when the integer-fold cover is attached to the integer-fold attachment.

2. A method of installing a design material set that covers a target surface, wherein the design material set comprises:

an attachment; and a cover to be attached to the attachment, the attachment and the cover have a base and a side wall surrounding the base, the cover is capable of being attached to the attachment by fitting the side wall of the cover to the side wall of the attachment, a shape of a part of the attachment facing the cover in plan view is a one-fold shape, which is inscribed in a minimum standard rectangle, or an integer-fold shape, which is inscribed in sides of a shape formed by an integer number of the minimum standard rectangles arranged side by side, provided that an attachment of the one-fold shape is referred to as a one-fold attachment, and an attachment of the integer-fold shape is referred to as an integer-fold attachment, the design material set includes a plurality of covers, the covers including a one-fold cover, which has a size that allows the cover to be attached to the one-fold attachment, or an integer-fold cover, which has a size that allows the cover to be attached to the integer-fold attachment, and including at least integer-fold covers of different integer-fold numbers, a plurality of attachments is arranged lengthwise and widthwise side by side on the target surface, a design pattern formed by a plurality of covers is configured by attaching the one-fold cover to the one-fold attachment, attaching the integer-fold cover to an integer number of one-fold attachments, the integer number being equal to or greater than 2, or attaching the integer-fold cover to the integer-fold attachment, the design pattern can be changed by removing a cover from the attachment and attaching a new cover, or rearranging the covers, the design pattern can be changed by replacing the integer-fold cover attached to the attachment with an integer-fold cover of a different integer-fold number, and the design pattern can be changed by changing the orientation of the integer-fold cover attached to the attachment to a lengthwise orientation or a widthwise orientation, wherein attachment of the one-fold cover to the one-fold attachment is attained by friction between the one-fold cover and the one-fold attachment, and attachment of the integer-fold cover to the integer-fold attachment is attained by friction between the integer-fold cover and the integer-fold attachment, and wherein a hollow space is formed inside the one-fold cover when the one-fold cover is attached to the one-fold attachment, and a hollow space is formed inside the integer-fold cover when the integer-fold cover is attached to the integer-fold attachment.

3. The design material set according to claim 1, wherein the side of the one-fold cover is parallel to the side of the one-fold attachment, and the side of the integer-fold cover is parallel to the side of the integer-fold attachment.

4. The design material set according to claim 1, the design material set further comprising a one-fold substrate fixed to a wall, or an integer-fold substrate fixed to a wall, the one-fold substrate is configured to accept the one-fold attachment and the one-fold cover, and the integer-fold substrate is configured to accept the integer-fold attachment and the integer-fold cover.

5. The design material set according to claim 4, wherein the one-fold substrate comprises a recess having a side wall and the one-fold attachment has a projection having a side wall that fits inside of the side wall of the recess of the one-fold substrate, and the integer-fold substrate comprises a recess having a side wall and the integer-fold attachment has a projection having a side wall that fits inside of the side wall of the recess of the integer-fold substrate.

* * * * *